US011069949B2

(12) United States Patent
Nakajima et al.

(10) Patent No.: US 11,069,949 B2
(45) Date of Patent: Jul. 20, 2021

(54) HOLLOW-WAVEGUIDE-TO-PLANAR-WAVEGUIDE TRANSITION CIRCUIT COMPRISING A COUPLING CONDUCTOR DISPOSED OVER SLOTS IN A GROUND CONDUCTOR

(71) Applicant: MITSUBISHI ELECTRIC CORPORATION, Tokyo (JP)

(72) Inventors: Hiromasa Nakajima, Tokyo (JP); Akimichi Hirota, Tokyo (JP); Naofumi Yoneda, Tokyo (JP); Takeshi Oshima, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 292 days.

(21) Appl. No.: 16/306,422

(22) PCT Filed: Jul. 5, 2016

(86) PCT No.: PCT/JP2016/069894

§ 371 (c)(1),
(2) Date: Nov. 30, 2018

(87) PCT Pub. No.: WO2018/008087

PCT Pub. Date: Jan. 11, 2018

(65) Prior Publication Data

US 2020/0235454 A1 Jul. 23, 2020

(51) Int. Cl.
*H01P 5/107* (2006.01)

(52) U.S. Cl.
CPC ..... *H01P 5/107* (2013.01)

(58) Field of Classification Search
CPC ..... H01P 5/107
(Continued)

(56) References Cited

U.S. PATENT DOCUMENTS 6,794,950 B2 9/2004 Du Toit et al.
10,811,753 B2 * 10/2020 Nakajima et al. ..... H01P 5/08
(Continued)

FOREIGN PATENT DOCUMENTS

CN 103996894 A 8/2014
CN 104485500 A 4/2015
(Continued)

OTHER PUBLICATIONS

International Search Report for PCT/JP2016/069894 (PCT/ISA/210) dated Sep. 20, 2016.
(Continued)

*Primary Examiner* — Benny T Lee
(74) *Attorney, Agent, or Firm* — Birch, Stewart, Kolasch & Birch, LLP

(57) ABSTRACT

A hollow-waveguide-to-planar-waveguide transition circuit includes: strip conductors formed on a first main surface of a dielectric substrate; a ground conductor formed on the back side, facing the strip conductors; a slot formed in the ground conductor; and a coupling conductor formed at a position to be electrically coupled with the strip conductors. The coupling conductor has: a main body portion electrically coupled with the strip conductors; and protruding portions protruding from the main body portion. The protruding portions are formed so as to face an end portion of the slot.

10 Claims, 16 Drawing Sheets

(58) Field of Classification Search
USPC ..... 333/26
See application file for complete search history.

(56) References Cited

U.S. PATENT DOCUMENTS

| | | | |
|---|---|---|---|
| 2011/0267153 | A1 | 11/2011 | Hirota et al. |
| 2013/0027259 | A1 | 1/2013 | Fujita et al. |

FOREIGN PATENT DOCUMENTS

| | | | |
|---|---|---|---|
| DE | 4441073 | C1 | 1/1996 |
| EP | 2403055 | A1 | 1/2012 |
| JP | 2002-198742 | A | 7/2002 |
| JP | 2010-56920 | A | 3/2010 |
| JP | 2013-31064 | A | 2/2013 |
| WO | WO 02/052674 | A1 | 7/2002 |
| WO | WO 2010/098191 | A1 | 9/2010 |

OTHER PUBLICATIONS

Japanese Office Action dated Aug. 21, 2018 in Japanese Application No. 2018-525861.
Chinese Office Action and Search Report for Chinese Application No. 201680087081.0, dated Jul. 23, 2020, with an English translation.
Indian Office Action for Indian Application No. 201847047355, dated Nov. 28, 2020, with an English translation.
European Communication Pursuant to Article 94(3) EPC, corresponding to EP Application No. 16 305 649.2, dated Mar. 23, 2021.

* cited by examiner

HOLLOW-WAVEGUIDE-TO-PLANAR-WAVEGUIDE TRANSITION CIRCUIT COMPRISING A COUPLING CONDUCTOR DISPOSED OVER SLOTS IN A GROUND CONDUCTOR

TECHNICAL FIELD

The present invention relates to a transition circuit for converting a transmission mode between a hollow waveguide and a planar waveguide such as a microstrip line.

BACKGROUND ART

In high-frequency transmission lines used in a high-frequency band such as a millimeter wave band or a microwave band, to couple a hollow waveguide and a planar waveguide such as a microstrip line or a coplanar line to each other, transition circuits for converting a transmission mode between the hollow waveguide and the planar waveguide are widely used. For example, Patent Literature 1 (Japanese Patent Application Publication No. 2010-56920) discloses a hollow-waveguide-to-microstrip-line transition circuit for coupling a hollow waveguide with a microstrip line.

The structure of the microstrip line disclosed in Patent Literature 1 includes a strip conductor and a conductor plate formed on a front surface of a dielectric substrate, a ground conductor disposed on the entire back surface of the dielectric substrate, and a plurality of connecting conductors disposed in the dielectric substrate and connecting the conductor plate to the ground conductor. The ground conductor is connected to an end portion of a rectangular waveguide, and this ground conductor has a rectangular slot to be electrically coupled with the end portion of the rectangular waveguide. The conductor plate and the ground conductor form a coplanar line structure. Furthermore, connecting conductors are arranged around the periphery of a short plane (i.e., short-circuit plane) of the end portion of the rectangular waveguide. By providing these connecting conductors, unnecessary radiation from the slot can be suppressed.

CITATION LIST

Patent Literatures

Patent Literature 1: Japanese Patent Application Publication No. 2010-56920, published on Mar. 11, 2010 (for example, FIGS. 1 and 2, paragraphs [0013] to [0018], FIGS. 12 and 13, and paragraphs [0043] to [0049] therein)

SUMMARY OF THE INVENTION

Technical Problem

However, with the structure disclosed in Patent Literature 1, there is the disadvantage that, because the connecting conductors are necessary for suppressing unnecessary radiation, the manufacturing process of the hollow-waveguide-to-microstrip-line transition circuit becomes complicated, thereby increasing manufacturing cost.

In view of the foregoing, an object of the present invention is to provide a hollow-waveguide-to-planar-waveguide transition circuit capable of suppressing unnecessary radiation as well as reducing manufacturing cost.

Solution to the Problem

In accordance with an aspect of the present invention, there is provided a hollow-waveguide-to-planar-waveguide transition circuit for transmitting a high-frequency signal. The hollow-waveguide-to-planar-waveguide transition circuit includes: a dielectric substrate having a first main surface and a second main surface which face each other in a thickness direction of the dielectric substrate; one or more strip conductors formed on the first main surface, extending in a first in-plane direction determined in advance; a ground conductor formed on the second main surface to face the one or more strip conductors in the thickness direction; one or more slots formed in the ground conductor and extending in a second in-plane direction different from the first in-plane direction on the second main surface; and a coupling conductor formed at a position to be electrically coupled with the one or more strip conductors on the first main surface, and disposed at a position facing the one or more slots in the thickness direction, the coupling conductor having a main body portion electrically coupled with the one or more strip conductors, and having a protruding portion protruding from the main body portion in the second in-plane direction, the protruding portion being formed and facing, in the thickness direction, an end portion of the one or more slots in the second in-plane direction.

Advantageous Effects of the Invention

In accordance with the present invention, a hollow-waveguide-to-planar-waveguide transition circuit can be provided which is capable of suppressing unnecessary radiation as well as achieving low manufacturing cost and high operation reliability.

DETAILED DESCRIPTION OF PREFERRED EMBODIMENTS

Figure 1:
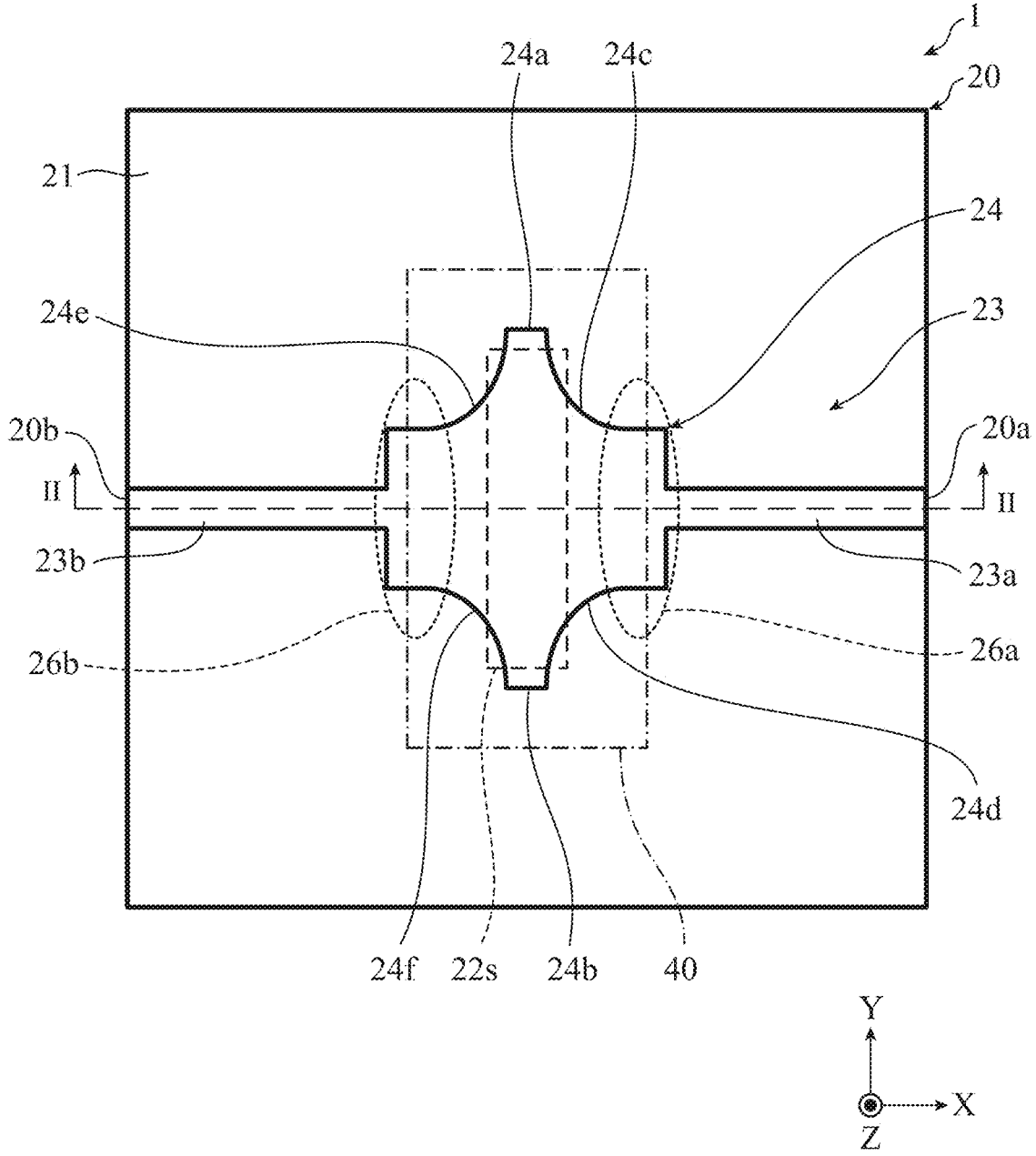
FIG. 1 is a schematic plan view of a hollow-waveguide-to-planar-waveguide transition circuit of a first embodiment according to the present invention.

Hereinafter, various embodiments according to the present invention will be described in detail with reference to the drawings. Note that constituent elements denoted by the same reference numeral throughout the drawings have the same configuration and the same function, the description thereof may not be repeated for every drawing figure in which they appear. X-axis, Y-axis, and Z-axis illustrated in the drawings are orthogonal to one another.

First Embodiment

Figure 2:
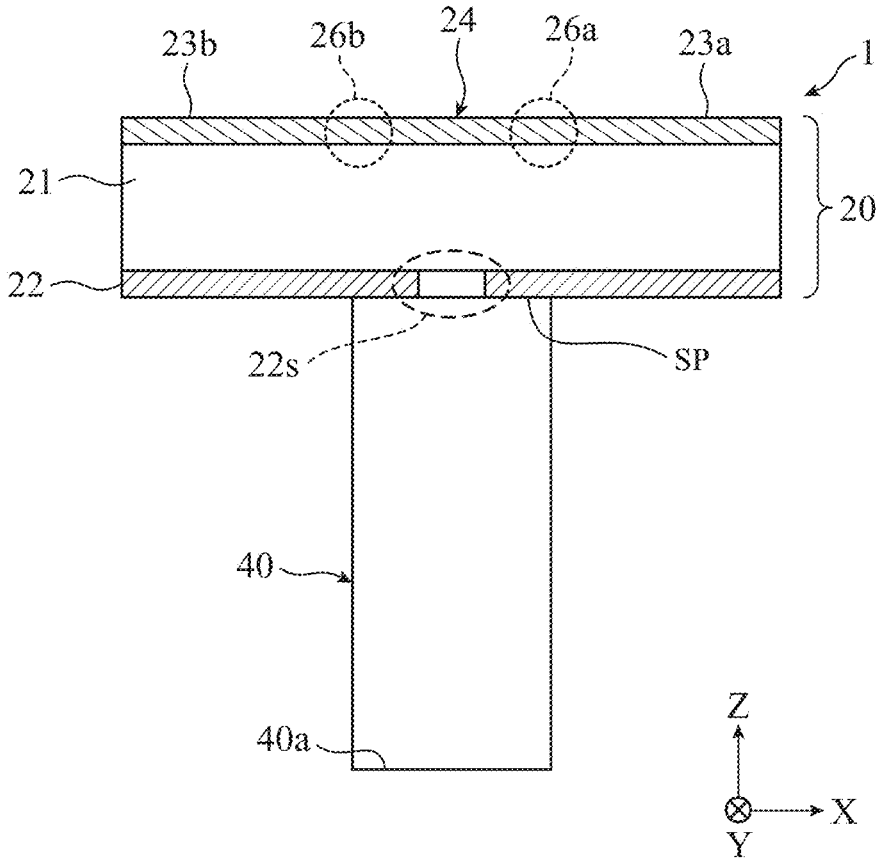
FIG. 2 is a schematic cross-sectional view taken along line II-II of the hollow-waveguide-to-planar-waveguide transition circuit illustrated in FIG. 1.

FIG. 1 is a view schematically illustrating the planar structure of a hollow-waveguide-to-planar-waveguide transition circuit 1 of a first embodiment according to the present invention. FIG. 2 is a schematic cross-sectional view taken along line II-II of the hollow-waveguide-to-planar-waveguide transition circuit 1 illustrated in FIG. 1.

As illustrated in FIGS. 1 and 2, the hollow-waveguide-to-planar-waveguide transition circuit 1 includes a planar waveguide structure 20 having input/output terminals 20*a* and 20*b*, as illustrated in FIG. 1, which are used for inputting and outputting a high-frequency signal, and a hollow waveguide 40 connected to the planar waveguide structure 20. The hollow-waveguide-to-planar-waveguide transition circuit 1 has a function of converting a transmission mode (particularly a fundamental transmission mode) of a high-frequency signal mutually between the hollow waveguide 40 and the planar waveguide structure 20, and has an impedance conversion function for converting a characteristic impedance mutually between the hollow waveguide 40 and the planar waveguide structure 20.

The hollow waveguide 40 is a metallic hollow-core waveguide having a rectangular cross section in a plane orthogonal to the guide axis of the hollow waveguide 40, that is, a rectangular waveguide. Although the tube thickness of the hollow waveguide 40 illustrated in FIG. 2 is omitted, there is actually a tube thickness of several millimeters. A hollow path of the hollow waveguide 40 extends in the guide-axis direction (Z-axis direction) of the hollow waveguide 40. The fundamental transmission mode of the hollow waveguide 40 is, for example, a $TE_{10}$ mode which is one of transverse electric modes (TE modes). Meanwhile, the fundamental transmission mode of the planar waveguide structure 20 is a quasi-transverse electromagnetic mode (quasi-TEM mode). The hollow-waveguide-to-planar-waveguide transition circuit 1 can convert a fundamental transmission mode of a high-frequency signal from one of the $TE_{10}$ mode and the quasi-TEM mode to the other.

As illustrated in FIG. 1, the planar waveguide structure 20 includes a dielectric substrate 21 having a quadrangle such as a square or a rectangle when viewed from the Z-axis direction, and a conductor pattern 23 formed on the front surface (i.e., first main surface) out of two facing surfaces of the dielectric substrate 21. Here, the front surface of the dielectric substrate 21 is parallel to an X-Y plane including the X-axis and the Y-axis. For example, the dielectric substrate 21 only needs to be formed of a dielectric material such as glass epoxy, polytetrafluoroethylene (PTFE), or ceramics.

The conductor pattern 23 includes two strip conductors 23*a* and 23*b* which are linear conductors extending in a predetermined in-plane direction (X-axis direction) on the front surface of the dielectric substrate 21, and a coupling conductor 24 interposed between the strip conductors 23*a* and 23*b* and physically connected to the strip conductors 23*a* and 23*b*.

As illustrated in FIG. 2, the planar waveguide structure 20 includes a ground conductor 22 which is a conductive film formed over the entire back surface (second main surface) of the dielectric substrate 21, a slot 22*s* which is a coupling window formed in the ground conductor 22, and the hollow waveguide 40 having one end portion connected to a predetermined area (including the slot 22*s*) of the ground conductor 22. The back surface of the dielectric substrate 21 is parallel to the X-Y plane. As illustrated in FIG. 1, the slot 22*s* extends in the Y-axis direction different from an extending direction (X-axis direction) of the strip conductors 23*a* and 23*b*, and has a rectangular shape having the Y-axis direction as a longitudinal direction.

The guide-axis direction of the hollow waveguide 40 is parallel to the Z-axis direction. A wall surface forming one end portion of the hollow waveguide 40 on the positive side of the Z-axis direction is physically connected to the ground conductor 22 to form a short plane (short-circuit plane) SP. The outer shape of the hollow waveguide 40 illustrated in FIG. 1 is a rectangular shape and represents the outer shape of the short plane SP, as illustrated in FIG. 2. The other end portion of the hollow waveguide 40 on the negative side of the Z-axis direction constitutes an input/output terminal 40*a* for use in input and output of a high-frequency signal.

The ground conductor 22 and the conductor pattern 23 can be formed by plating, for example. As a constituent material of the conductor pattern 23 and the ground conductor 22, it is only required to use, for example, any one of conductive materials such as copper, silver, and gold, or a combination of two or more materials selected from these conductive materials.

As illustrated in FIGS. 1 and 2, the coupling conductor 24 is disposed at a position facing the slot 22*s* disposed on the back side of the dielectric substrate 21 in the Z-axis direction (thickness direction of the dielectric substrate 21). As illustrated in FIG. 1, the coupling conductor 24 has a substantially rectangular main body portion connected to inner end portions of the strip conductors 23*a* and 23*b*, a protruding portion 24*a* protruding from the main body portion in the Y-axis positive direction, and a protruding portion 24*b* protruding from the main body portion in the Y-axis negative direction. Impedance adjusting units 26*a* and 26*b* are formed near both ends of the main body portion in the X-axis direction.

As illustrated in FIG. 1, the protruding portion 24*a* which is one of the protruding portions of the coupling conductor 24 is formed so as to face, in the Z-axis direction, the end portion of the slot 22*s* on the positive side of the Y-axis direction, and the protruding portion 24*b* which is the other protruding portion is formed so as to face, in the Z-axis direction, the end portion of the slot 22*s* on the negative side of the Y-axis direction. A tip of the protruding portion 24*a* which is one of the protruding portions is disposed on the positive side of the Y-axis direction and outside one end portion of the slot 22*s* in a longitudinal direction of the slot 22*s*. A tip of the protruding portion 24*b* which is the other protruding portion is disposed on the negative side of the Y-axis direction and outside the other end portion of the slot 22*s* in the longitudinal direction.

The protruding portion 24*a* which is one of the protruding portions has a pair of inclined portions 24*c* and 24*e* which form a tapered shape. That is, the protruding portion 24*a* has a tapered shape in which the lateral width (width in the X-axis direction) of the protruding portion 24*a* changes in a manner that gradually decreases the lateral width as the location of the lateral width changes from the main body portion toward the tip of the protruding portion 24*a*. The protruding portion 24*b* which is the other protruding portion also has a pair of inclined portions 24*d* and 24*f* which form a tapered shape. That is, the protruding portion 24*b* has a tapered shape in which the lateral width of the protruding portion 24*b* changes in a manner that gradually decreases the lateral width as the location of the lateral width changes from the main body portion toward the tip of the protruding portion 24*b*.

Figure 3:
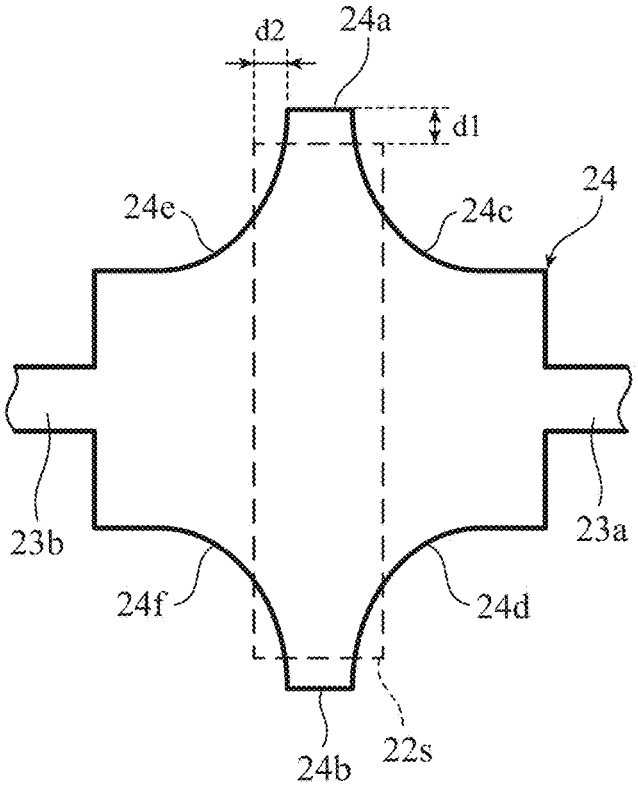
FIG. 3 is an enlarged view of a conductor portion of the first embodiment.

Furthermore, as illustrated in FIG. 1, each of the tips of the protruding portions 24*a* and 24*b* has a certain lateral width. The lateral width of the tip of the protruding portion 24*a* which is one of the protruding portions is narrower than the lateral width of one end portion of the slot 22*s*, and the lateral width of the tip of the protruding portion 24*b* which is the other protruding portion is also narrower than the lateral width of the other end portion of the slot 22*s*. FIG. 3 is an enlarged view of the coupling conductor 24 illustrated in FIG. 1. As illustrated in FIG. 3, a distance d1 in a longitudinal direction (Y-axis direction) between the tip of one end portion of the slot 22*s* and the tip of the protruding portion 24*a* is set so as to be equal to or less than one eighth (=λ/8) of a wavelength A corresponding to a center frequency of a predetermined frequency band to be used. A distance in the longitudinal direction between the tip of the other end portion of the slot 22*s* and the tip of the protruding portion 24*b* is similarly set so as to be equal to or less than λ/8.

As illustrated in FIG. 3, a distance d2 in a lateral direction between the tip of the protruding portion 24*a* and the left end of one end portion of the slot 22*s* in the lateral direction (X-axis direction, as shown in FIG. 1) is set so as to be equal to or less than one eighth of the wavelength λ. A distance in a lateral direction between the tip of the protruding portion 24*a* and the right end of the other end portion of the slot 22*s* in the lateral direction is also set similarly. A distance in a lateral direction between the tip of the protruding portion 24*b* which is the other protruding portion and the left end or the right end of one end portion of the slot 22*s* in the lateral direction is also set so as to be equal to or less than one eighth of the wavelength λ. Therefore, the distance in each of the longitudinal direction and the lateral direction between the tip of the protruding portion 24*a* and an edge of one end portion of the slot 22*s* is set so as to be within one eighth of the wavelength λ. Similarly, the distance in each of the longitudinal direction and the lateral direction between the tip of the protruding portion 24*b* and an edge of the other end portion of the slot 22*s* is set so as to be within one eighth of the wavelength A.

Next, operation of the hollow-waveguide-to-planar-waveguide transition circuit 1 of the present embodiment will be described with reference to FIGS. 1 and 2.

In the planar waveguide structure 20 of the present embodiment, the strip conductors 23*a* and 23*b*, the ground conductor 22 facing the strip conductors 23*a* and 23*b*, and a dielectric interposed between the ground conductor 22 and the strip conductors 23*a* and 23*b* form a microstrip line. The coupling conductor 24, the ground conductor 22 (FIG. 2) facing the coupling conductor 24, and a dielectric 21 (FIG. 2) interposed between the ground conductor 22 and the coupling conductor 24 form a parallel flat line.

When a high-frequency signal is input to the input/output terminal 40*a* of the hollow waveguide 40, the input high-frequency signal excites the slot 22*s*, as illustrated in FIG. 2. Because the longitudinal direction of the slot 22*s* intersects the longitudinal direction (extending direction) of the strip conductors 23*a* and 23*b*, the excited slot 22*s* and the strip conductors 23*a* and 23*b* are magnetically coupled with each other. The high-frequency signal is propagated via the parallel flat line to the input/output terminals 20*a* and 20*b* (FIG. 1) of the microstrip line and output. At this time, the slot 22*s* is excited in the same phase. The strip conductors 23*a* and 23*b* are disposed so as to extend in opposite directions to each other with respect to the slot 22*s*. Therefore, the input/output terminals 20*a* and 20*b* perform output in opposite phases to each other. Conversely, when high-frequency signals in opposite phases to each other are input to the input/output terminals 20*a* and 20*b* of the planar waveguide structure 20, these high-frequency signals are combined and then output from the input/output terminal 40*a* of the hollow waveguide 40.

Figure 4:
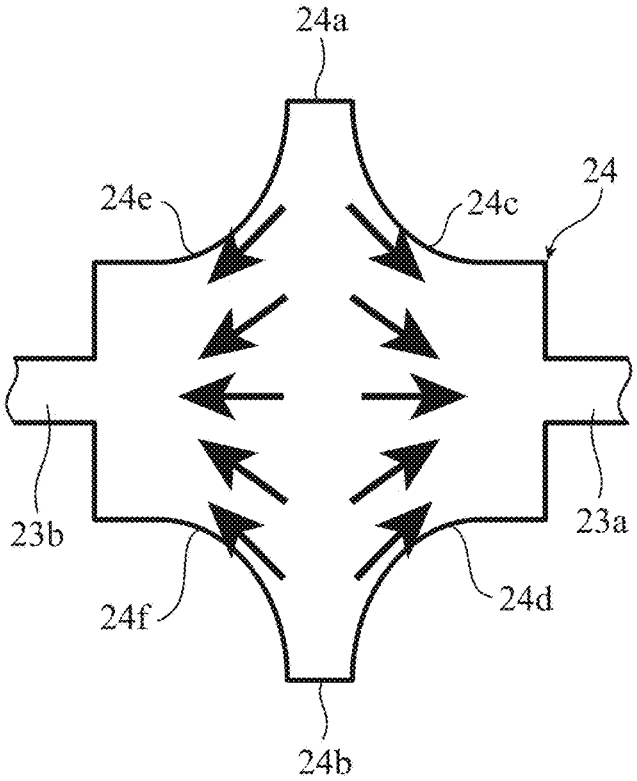
FIG. 4 is a view schematically illustrating a propagation direction of a high-frequency signal.

Because the direction of an electric field formed in the slot 22*s* is parallel to a short-axis direction (X-axis direction, as illustrated in FIG. 2) of the slot 22*s*, a parallel flat mode in a direction parallel to the extending direction of the strip conductors 23*a* and 23*b* is generated. Electric field intensity in the slot 22*s* is largest at a midportion of the slot 22*s* and is zero at an end portion of the slot 22*s*. Therefore, the electric field intensity at an end portion of the parallel flat line in the Y-axis direction (that is, a line portion near the tips of the protruding portions 24*a* and 24*b*, as illustrated in FIG. 1) is extremely weak, and the amount of unnecessary radiation from the end portion of the parallel flat line in the Y-axis direction is small in a direction orthogonal to a travelling direction of a high-frequency signal. FIG. 4 is a view schematically illustrating a propagation direction of a high-frequency signal transmitted between the coupling conductor 24 and the ground conductor 22 when viewed from the Z-axis direction. As illustrated in FIG. 4, the high-frequency signal propagated from the hollow waveguide 40 (see FIG. 2) is distributed to the two strip conductors 23*a* and 23*b* via the slot 22*s* (see FIGS. 1-3). Due to the tapered structure of the coupling conductor 24, the propagation direction of the high-frequency signal can be gradually changed continuously, and the traveling direction of the high-frequency signal can be directed toward the strip conductors 23*a* and 23*b*. This makes it possible to efficiently propagate the high-frequency signal to the strip conductors 23*a* and 23*b* while suppressing unnecessary radiation.

Furthermore, as illustrated in FIG. 3, the size of the tip portion covering one end portion of the slot 22*s* in the protruding portion 24*a* in the Y-axis direction (see FIG. 1) is about the same as the size of one end portion of the slot 22*s*. The size of the tip portion covering the other end portion of the slot 22*s* in the protruding portion 24*b* in the Y-axis direction is also about the same as the size of the other end portion of the slot 22*s*. Therefore, at the both end portions of the slot 22*s* in the Y-axis direction, because the covering area where the slot 22*s* is covered with the protruding portions 24*a* and 24*b* is small, a parallel flat mode is hardly generated. As a result, the high-frequency signal concentrates on the midportion of the slot 22*s* and is propagated from the midportion of the slot 22*s* toward the strip conductors 23*a* and 23*b* in the parallel flat mode, and therefore efficient conversion can be executed while unnecessary radiation is suppressed. This is indicated by the arrows in FIG. 4.

In short, the size of each of the tip portions of the protruding portions 24*a* and 24*b* covering the both end portions of the slot 22*s* in the Y-axis direction (see FIG. 1) is about the same as the size of each of the both end portions of the slot 22*s*, and a tapered structure is formed in the coupling conductor 24. As a result, the high-frequency signal can be efficiently transmitted to the strip conductors 23*a* and 23*b* while unnecessary radiation is suppressed.

Figure 5:
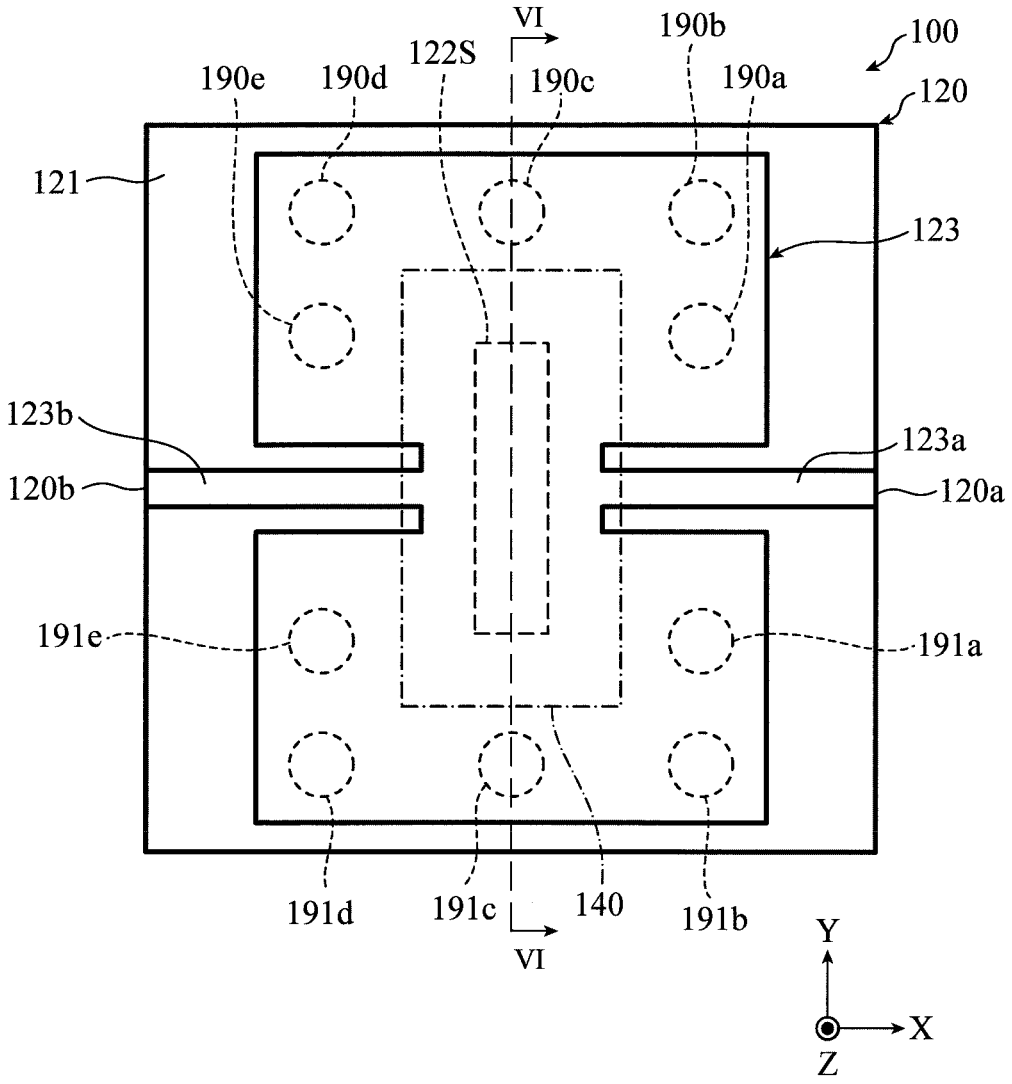
FIG. 5 (Prior Art)
FIG. 5 is a schematic plan view of a conventional hollow-waveguide-to-microstrip-line transition circuit.
Figure 6:
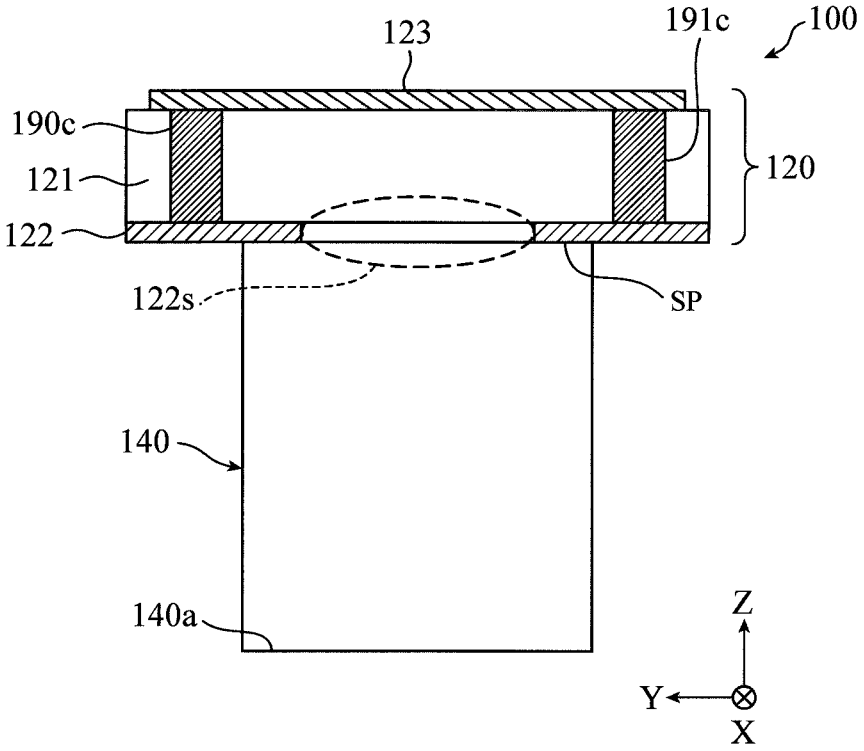
FIG. 6 (Prior Art)
FIG. 6 is a schematic cross-sectional view taken along line VI-VI of the hollow-waveguide-to-planar-waveguide transition circuit illustrated in FIG. 5.

The hollow-waveguide-to-planar-waveguide transition circuit 1 of the present embodiment (as illustrated in FIGS. 1 and 2) can suppress unnecessary radiation without requiring a connecting conductor connecting the conductor pattern 23 on the front surface of the dielectric substrate 21 and the ground conductor 22 on the back surface of the dielectric substrate 21 to each other. FIG. 5 is a view schematically illustrating a planar waveguide structure 120 of a conventional hollow-waveguide-to-microstrip-line transition circuit 100 including such connecting conductors 190*a*, 190*b*, 190*c*, 190*d*, and 190*e* and 191*a*, 191*b*, 191*c*, 191*d*, and 191*e*. FIG. 6 is a schematic cross-sectional view taken along line VI-VI of the hollow-waveguide-to-microstrip-line transition circuit 100 illustrated in FIG. 5. A configuration substantially the same as that of the hollow-waveguide-to-microstrip-line transition circuit 100 is disclosed in Patent Literature 1 (Japanese Patent Application Publication No. 2010-56920).

As illustrated in FIG. 5, the planar waveguide structure 120 of the hollow-waveguide-to-microstrip-line transition circuit 100 includes: strip conductors 123*a* and 123*b* formed on the front surface of a dielectric substrate 121; a conductor plate 123 formed so as to be connected to the strip conductors 123*a* and 123*b* on the front surface; a ground conductor 122 formed on the back surface of the dielectric substrate 121; a rectangular slot 122S formed in the ground conductor 122; and columnar connecting conductors 190*a* to 190*e* and 191*a* to 191*e* disposed in the dielectric substrate 121 and connecting the conductor plate 123 to the ground conductor 122 as shown in FIG. 6. As illustrated in FIG. 6, an end portion of a rectangular waveguide 140 is in contact with the ground conductor 122 to form a short plane (i.e., short-circuit plane) SP. The connecting conductors 190*a* to 190*e* and 191*a* to 191*e* are disposed so as to surround the short plane SP of the rectangular waveguide 140.

When a high-frequency signal is input to the input/output terminal 140*a* of the hollow waveguide 140, the input high-frequency signal excites the slot 2*s*. Because the longitudinal direction of the slot 2*s* intersects the longitudinal direction of the strip conductors 123*a* and 123*b*, the excited slot 122*s* and the strip conductors 123*a* and 123*b* are magnetically coupled with each other. The high-frequency signal is output from the input/output terminals 120*a* and 120*b* (FIG. 5) of a microstrip line formed by the strip conductors 123*a* and 123*b* and the ground conductor 122 (FIG. 6) via a parallel flat line formed by the conductor plate 123 and the ground conductor 122. The hollow-waveguide-to-microstrip-line transition circuit 100 can suppress unnecessary radiation from the slot 122S by disposing the connecting conductors 190*a* to 190*e* and 191*a* to 191*e*.

In order to dispose the connecting conductors 190*a* to 190*e* and 191*a* to 191*e*, for example, a step of forming a through hole passing from the front surface to the back surface in the dielectric substrate 121 and a step of forming a conductor in the through hole (for example, a plating step and an etching step) are required. FIG. 6 shows an example of connecting conductors 190*c* and 191*c* disposed in such a manner. However, these steps complicate a process for manufacturing the hollow-waveguide-to-microstrip-line transition circuit 100, and increase its manufacturing cost.

When the dielectric substrate 121 of the hollow-waveguide-to-microstrip-line transition circuit 100 expands and contracts due to temperature change, tension is applied to the connecting conductors 190*a* to 190*e* and 191*a* to 191*e*. As a result, the connecting conductors 190*a* to 190*e* and 191*a* to 191*e* may be broken, or characteristics of the hollow-waveguide-to-microstrip-line transition circuit 100 may be deteriorated.

Meanwhile, the hollow-waveguide-to-planar-waveguide transition circuit 1 of the present embodiment can suppress unnecessary radiation without requiring a connecting conductor, and therefore can realize lower manufacturing cost and higher operation reliability than the hollow-waveguide-to-microstrip-line transition circuit 100.

As described above with respect to FIGS. 1 and 2, because the coupling conductor 24 has the protruding portions 24*a* and 24*b* facing the both end portions of the slot 22*s*, the hollow-waveguide-to-planar-waveguide transition circuit 1 of the first embodiment (as illustrated in FIGS. 1 and 2) can achieve low manufacturing cost and high operation reliability while suppressing unnecessary radiation. In addition, because the structure of the present embodiment does not require the connecting conductors 190*a* to 190*e* and 191*a* to 191*e* unlike the conventional hollow-waveguide-to-microstrip-line transition circuit 100 as shown in FIGS. 5 and 6, and can downsize the hollow-waveguide-to-planar-waveguide transition circuit 1.

Second Embodiment

Although the first embodiment (as illustrated in FIGS. 1 and 2) has a structure in which the strip conductors 23*a* and 23*b* and the coupling conductor 23*c* are physically connected to each other in the impedance adjusting units 26*a* and 26*b*, although no limitation thereto is intended. The first embodiment may be modified so as to have a structure having a strip conductor and a coupling conductor physically separated from each other. Second and third embodiments each having such a structure will be described below.

Figure 7:
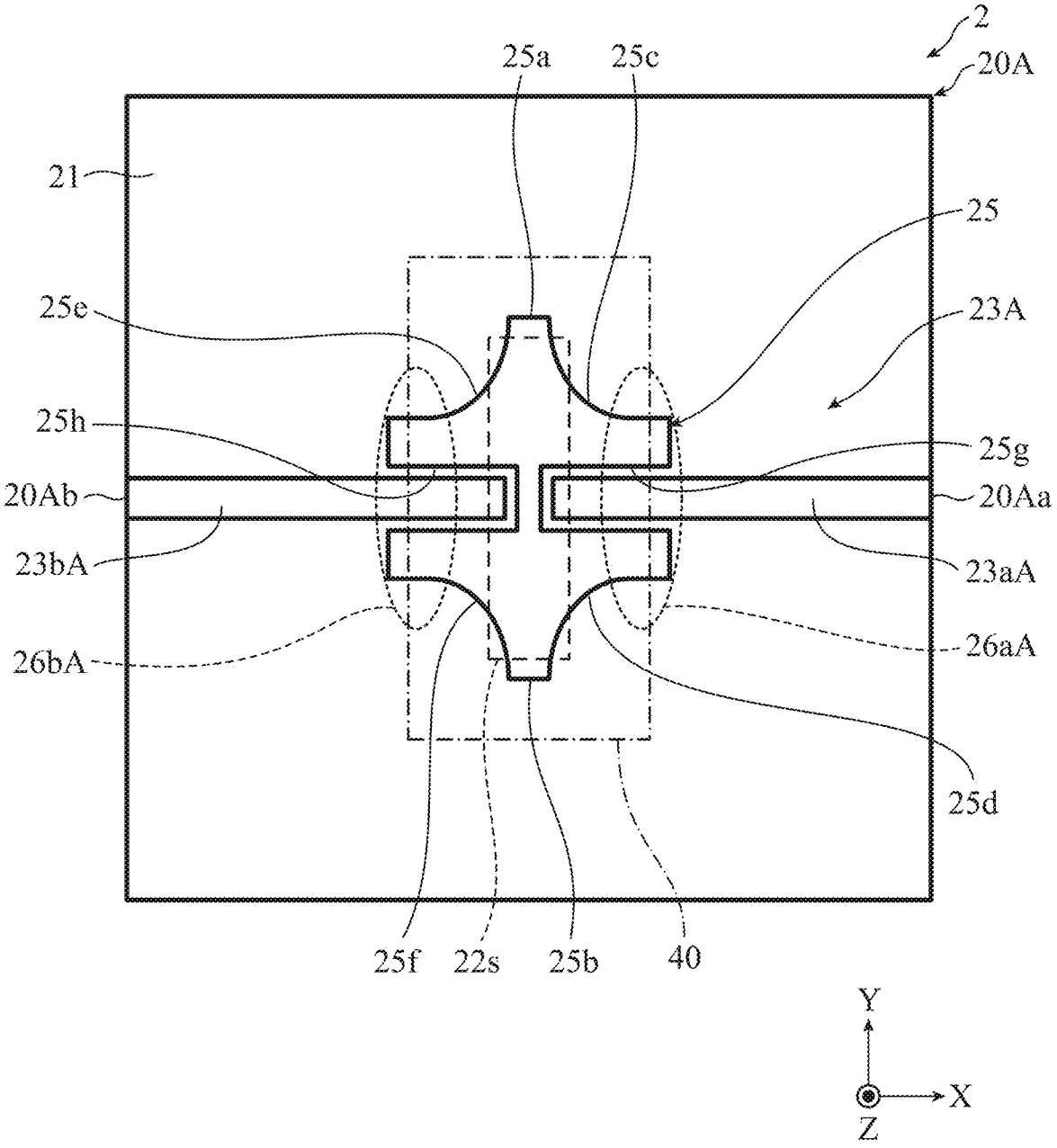
FIG. 7 is a schematic plan view of a hollow-waveguide-to-planar-waveguide transition circuit of a second embodiment according to the present invention.

FIG. 7 is a view schematically illustrating the planar structure of a hollow-waveguide-to-planar-waveguide transition circuit 2 of the second embodiment which is a first modification of the first embodiment. The configuration of the hollow-waveguide-to-planar-waveguide transition circuit 2 is the same as that of the hollow-waveguide-to-planar-waveguide transition circuit 1 of the first embodiment (as illustrated in FIGS. 1 and 2) except for having a conductor pattern 23A of FIG. 7 instead of the conductor pattern 23 of FIG. 1. A step of forming the conductor pattern 23A is the same as the step of forming the conductor pattern 23.

As illustrated in FIG. 7, the hollow-waveguide-to-planar-waveguide transition circuit 2 of the present embodiment includes a planar waveguide structure 20A having input/output terminals 20Aa and 20Ab, and the planar waveguide structure 20A has the conductor pattern 23A on the front surface of a dielectric substrate 21. The conductor pattern 23A includes strip conductors 23*a*A and 23*b*A physically separated from each other in the X-axis direction and a coupling conductor 25. Like the coupling conductor 24 of the first embodiment, the coupling conductor 25 has protruding portions 25*a* and 25*b* protruding from a main body portion of the coupling conductor 25 in the Y-axis direction. The protruding portions 25*a* and 25*b* have inclined portions 25*c*, 25*e*, 25*d*, and 25*f* which form tapered shapes, and are disposed so as to face, in the Z-axis direction, both end portions of a slot 22*s* in the Y-axis direction. The shapes, dispositions, and functions of these protruding portions 25*a* and 25*b* are the same as those of the protruding portions 24*a* and 24*b* of the first embodiment (as illustrated in FIGS. 1 and 2).

The coupling conductor 25 has a recessed portion 25*g* recessed in the X-axis negative direction and a recessed portion 25*h* recessed in the X-axis positive direction. An inner end portion of the strip conductor 23*a*A which is one of the strip conductors is surrounded by a recessed portion 23*g*, and an inner end portion of the strip conductor 23*b*A which is the other strip conductor is surrounded by a recessed portion 23*h*. The structure of the coupling conductor 25 of the present embodiment is substantially the same as the structure in which the recessed portions 23*g* and 23*h* are formed by processing the coupling conductor 24 of the first embodiment (as illustrated in FIGS. 1 and 2). As illustrated in FIG. 7, impedance adjusting units 26*a*A and 26*b*A of the present embodiment are formed near the recessed portions 25*g* and 25*h*.

Because the coupling conductor 25 has the protruding portions 25*a* and 25*b* facing the both end portions of the slot 22*s* as in the first embodiment, the hollow-waveguide-to-planar-waveguide transition circuit 2 of the present embodiment also can achieve low manufacturing cost and high operation reliability while suppressing unnecessary radiation.

Third Embodiment

Figure 8:
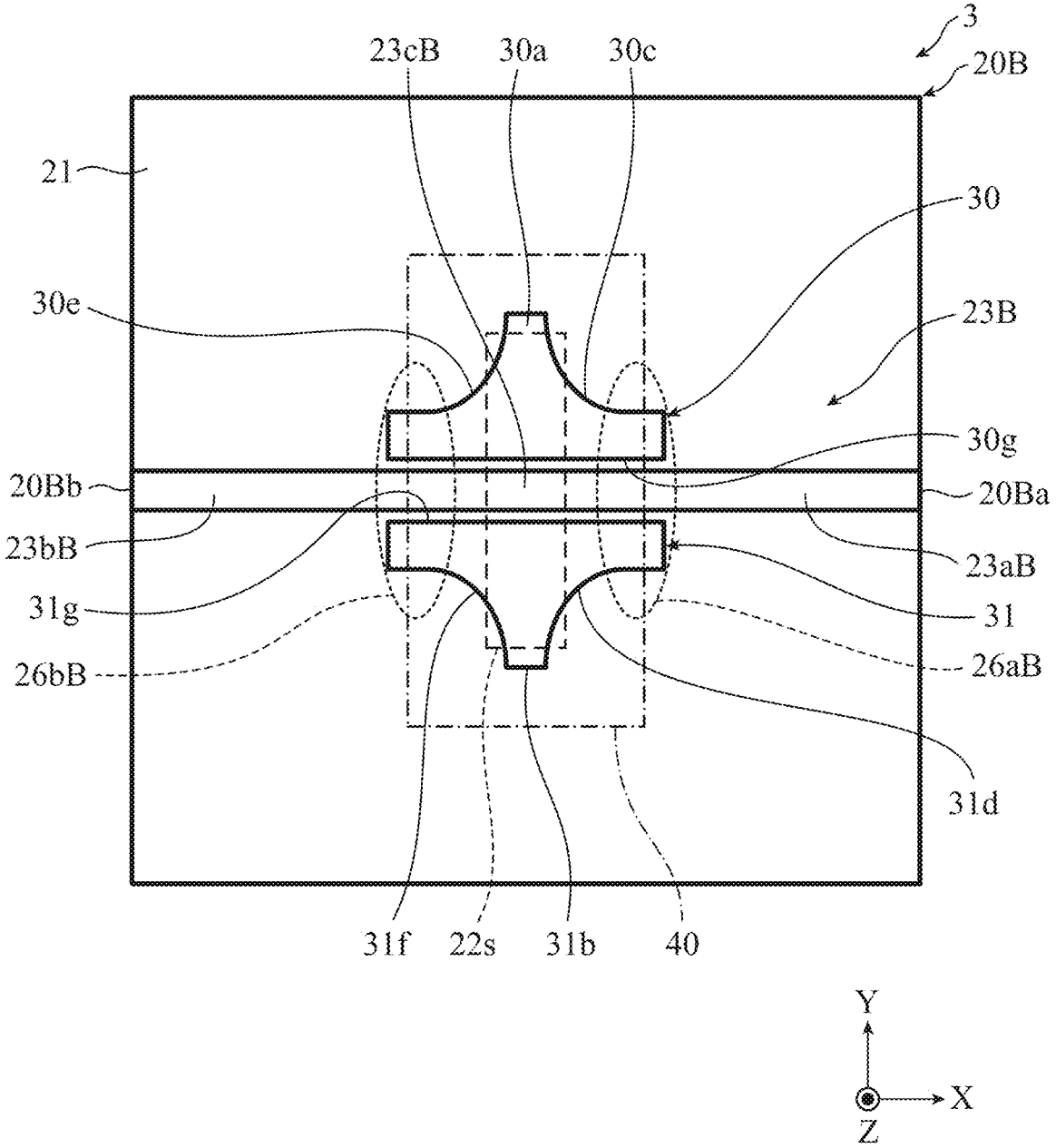
FIG. 8 is a schematic plan view of a hollow-waveguide-to-planar-waveguide transition circuit of a third embodiment according to the present invention.

FIG. 8 is a view schematically illustrating the planar structure of a hollow-waveguide-to-planar-waveguide transition circuit 3 of a third embodiment according to the present invention. The configuration of the hollow-waveguide-to-planar-waveguide transition circuit 3 is the same as that of the hollow-waveguide-to-planar-waveguide transition circuit 1 of the first embodiment (as illustrated in FIGS. 1 and 2) except for having a conductor pattern 23B of FIG. 8 instead of the conductor pattern 23 of FIG. 1. A step of forming the conductor pattern 23B is the same as the step of forming the conductor pattern 23.

As illustrated in FIG. 8, the hollow-waveguide-to-planar-waveguide transition circuit 3 of the present embodiment includes a planar waveguide structure 20B having input/output terminals 20Ba and 20Bb, and the planar waveguide structure 20B has the conductor pattern 23B on the front surface of a dielectric substrate 21. The conductor pattern 23B includes strip conductors 23*a*B and 23*b*B connected via a connecting portion 23*c*B in the X-axis direction, a first coupling conductor 30, and a second coupling conductor 31. The first coupling conductor 30 and the second coupling conductor 31 constitute a coupling conductor of the present embodiment.

Like the coupling conductor 24 of the first embodiment, the first coupling conductor 30 has a protruding portion 30*a* protruding from a main body portion of the first coupling conductor 30 in the Y-axis positive direction, and the second coupling conductor 31 has a protruding portion 31*b* protruding from a main body portion of the second coupling conductor 31 in the Y-axis negative direction. The protruding portions 30*a* and 31*b* have inclined portions 30*c*, 30*e*, 31*d*, and 31*f* which form tapered shapes, and are disposed so as to face, in the Z-axis direction, both end portions of a slot 22*s* in the Y-axis direction. The shapes, dispositions, and functions of these protruding portions 30*a* and 31*b* are the same as those of the protruding portions 24*a* and 24*b* of the first embodiment (as illustrated in FIGS. 1 and 2).

The first coupling conductor 30 and the second coupling conductor 31 are physically separated from each other, and the strip conductors 23*a*B and 23*b*B and the connecting portion 23*c*B are disposed in an area between the first coupling conductor 30 and the second coupling conductor 31. As illustrated in FIG. 8, impedance adjusting units 26*a*B and 26*b*B of the present embodiment are formed near both ends of the first coupling conductor 30 and the second coupling conductor 31 in the X-axis direction, respectively.

Because the first coupling conductor 30 and the second coupling conductor 31 have the protruding portions 30*a* and 31*b* facing the both end portions of the slot 22*s* as in the first embodiment, the hollow-waveguide-to-planar-waveguide transition circuit 3 of the present embodiment also can achieve low manufacturing cost and high operation reliability while suppressing unnecessary radiation.

Fourth Embodiment

Each of the above-described hollow-waveguide-to-planar-waveguide transition circuits 1 to 3 of the first to third embodiments has the single slot 22*s*, although no limitation thereto is intended. The first to third embodiments, respectively, may be modified so as to include two or more slots. Fourth, fifth, and sixth embodiments each including a plurality of slots will be described below.

Figure 9:
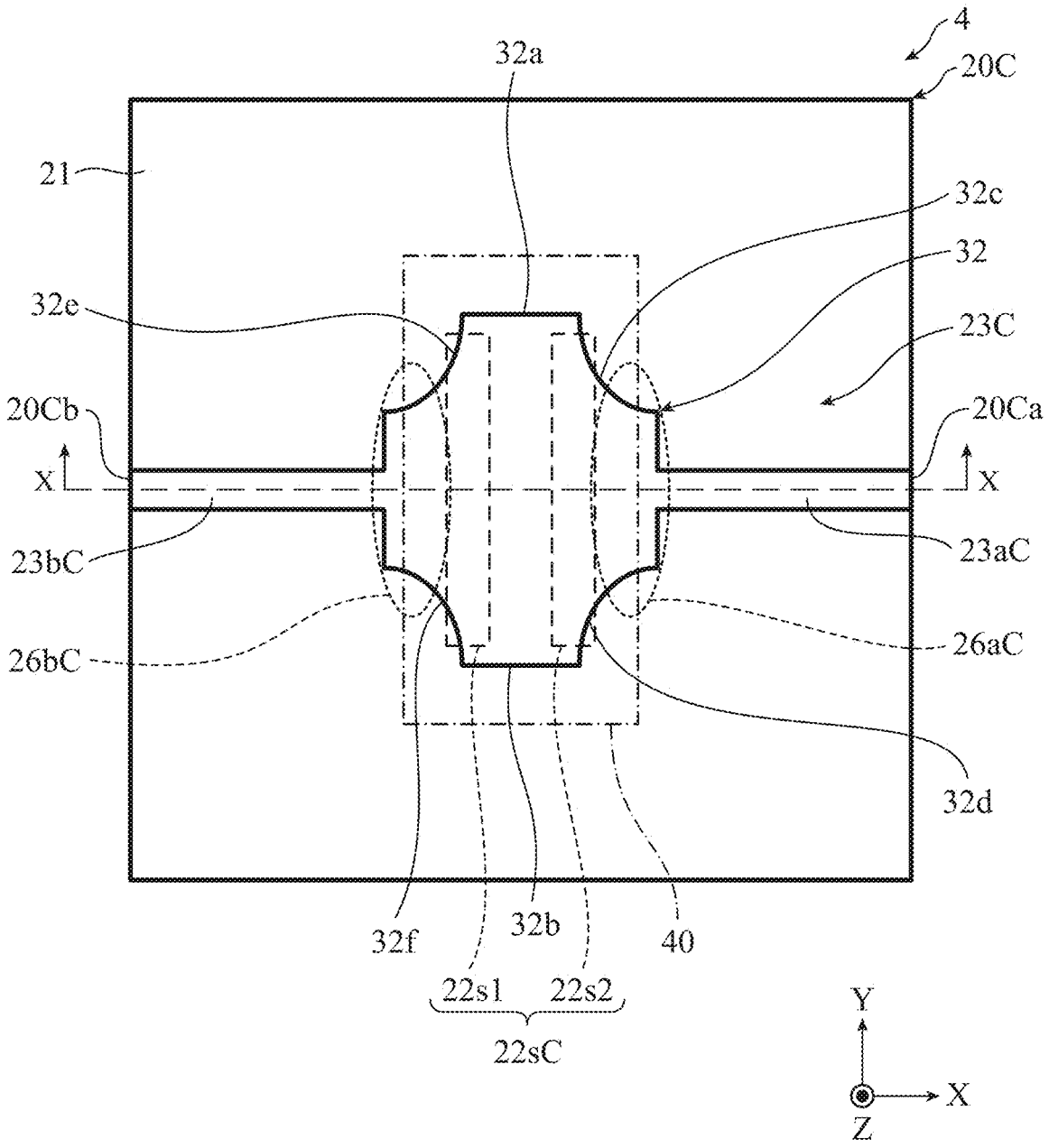
FIG. 9 is a schematic plan view of a hollow-waveguide-to-planar-waveguide transition circuit of a fourth embodiment according to the present invention.
Figure 10:
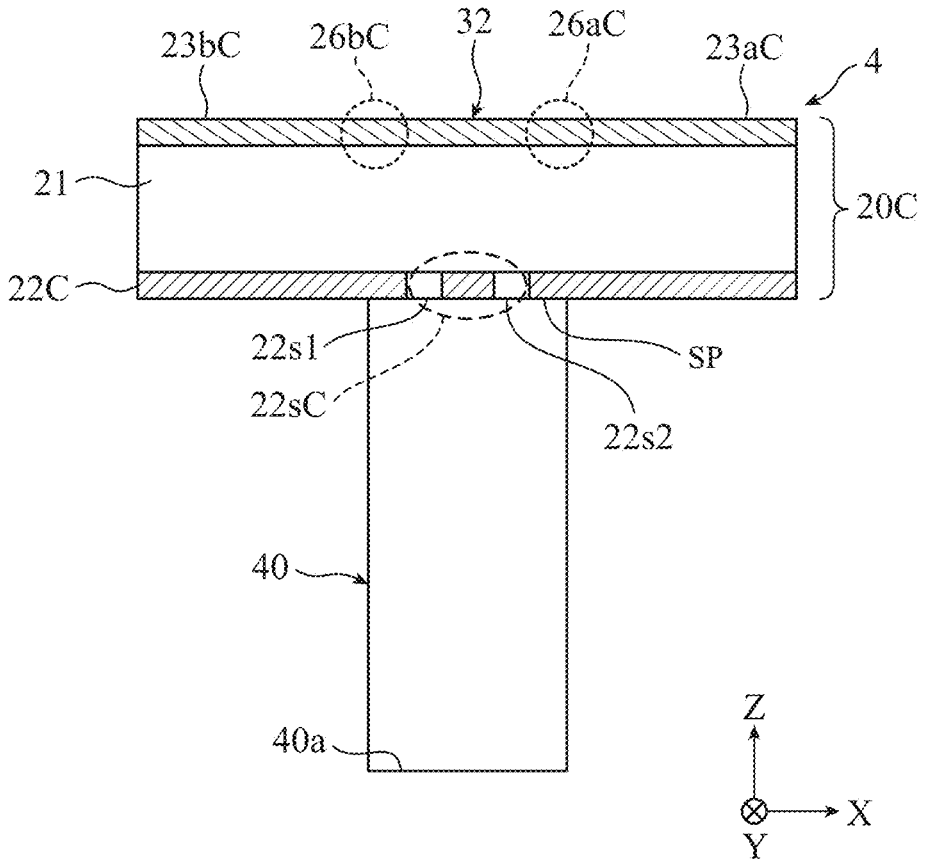
FIG. 10 is a schematic cross-sectional view taken along line X-X of the hollow-waveguide-to-planar-waveguide transition circuit illustrated in FIG. 9.

FIG. 9 is a view schematically illustrating the planar structure of a hollow-waveguide-to-planar-waveguide transition circuit 4 of a fourth embodiment according to the present invention. FIG. 10 is a schematic cross-sectional view taken along line X-X of the hollow-waveguide-to-planar-waveguide transition circuit 4 illustrated in FIG. 9.

The hollow-waveguide-to-planar-waveguide transition circuit 4 of the present embodiment includes a planar waveguide structure 20C having input/output terminals 20Ca and 20Cb as illustrated in FIG. 9, and the planar waveguide structure 20C has a conductor pattern 23C (FIG. 9) on the front surface of a dielectric substrate 21. As illustrated in FIG. 10, a ground conductor 22C is disposed on the back surface of the dielectric substrate 21. In the ground conductor 22C, a slot group 22*s*C including rectangular slots 22*s*1 and 22*s*2 extending in the Y-axis direction is formed.

The conductor pattern 23C includes strip conductors 23*a*C and 23*b*C extending in the X-axis direction and a coupling conductor 32 electrically coupled with the strip conductors 23*a*C and 23*b*C. The strip conductors 23*a*C and 23*b*C are disposed so as to extend in opposite directions (X-axis positive direction and X-axis negative direction) to each other with respect to the slot group 22*s*C. A main body portion of the coupling conductor 32 of the present embodiment is physically connected to inner end portions of the strip conductors 23*a*C and 23*b*C.

Like the coupling conductor 24 of the first embodiment (as illustrated in FIGS. 1 and 2), the coupling conductor 32 has protruding portions 32*a* and 32*b* (FIG. 9) protruding from the main body portion of the coupling conductor 32 in the Y-axis direction, and these protruding portions 32*a* and 32*b* have inclined portions 32*c*, 32*e*, 32*d*, and 32*f* which form tapered shapes, and are disposed so as to face, in the Z-axis direction, both end portions of a slot 22*s* in the Y-axis direction. As illustrated in FIG. 9, impedance adjusting units 26*a*C and 26*b*C of the present embodiment are formed near the both ends of the main body portion of the coupling conductor 32 in the X-axis direction.

The lateral width (width in the X-axis direction) of a tip of the protruding portion 32*a* is narrower than the entire width of the slot group 22*s*C including the slots 22*s*1 and 22*s*2, and the lateral width (width in the X-axis direction) of a tip of the protruding portion 32*b* is also narrower than the entire width of the slot group 22*s*C including the slots 22*s*1 and 22*s*2. A distance in each of a longitudinal direction (Y-axis direction) and a lateral direction (X-axis direction) between an edge of one end portion of the slot group 22*s*C in the Y-axis direction and the tip of the protruding portion 32*a* is set so as to be equal to or less than one eighth (=λ/8) of the wavelength A corresponding to a center frequency of a frequency band to be used. A distance in each of the longitudinal direction and the lateral direction between an edge of the other end portion of the slot group 22*s*C in the Y-axis direction and the tip of the protruding portion 32*b* is similarly set so as to be equal to or less than λ/8.

As illustrated in FIG. 9, the size of the tip portion covering one end portion of the slot group 22*s*C in the protruding portion 32*a* in the Y-axis direction is about the same as the size of one end portion of the slot group 22*s*C. The size of the tip portion covering the other end portion of the slot group 22*s*C in the protruding portion 32*b* in the Y-axis direction is also about the same as the size of the other end portion of the slot group 22*s*C. Therefore, the function of the protruding portions 32*a* and 32*b* is substantially the same as the function of the protruding portions 24*a* and 24*b* of the first embodiment. Therefore, it is possible to efficiently transmit a high-frequency signal to the strip conductors 23*a*C and 23*b*C while suppressing unnecessary radiation.

As described above, the hollow-waveguide-to-planar-waveguide transition circuit 4 of the present embodiment also can achieve low manufacturing cost and high operation reliability while suppressing unnecessary radiation as in the first embodiment.

Fifth Embodiment

Figure 11:
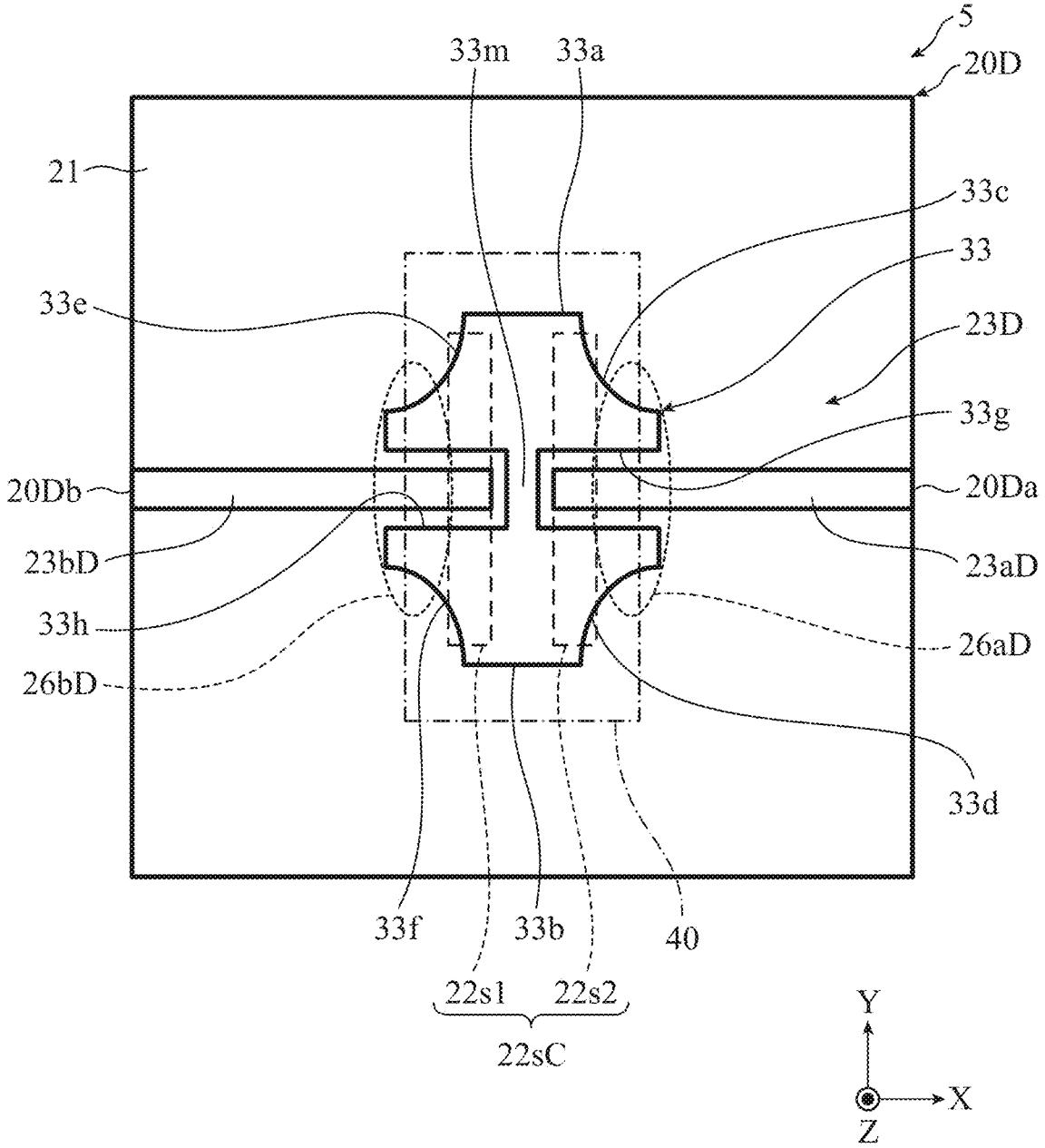
FIG. 11 is a schematic plan view of a hollow-waveguide-to-planar-waveguide transition circuit of a fifth embodiment according to the present invention.

FIG. 11 is a view schematically illustrating the planar structure of a hollow-waveguide-to-planar-waveguide transition circuit 5 of a fifth embodiment according to the present invention. The hollow-waveguide-to-planar-waveguide transition circuit 5 of the present embodiment includes a planar waveguide structure 20D having input/output terminals 20Da and 20Db as illustrated in FIG. 11, and the planar waveguide structure 20D has a conductor pattern 23D on the front surface of a dielectric substrate 21. A ground conductor (not shown) is disposed on the back surface of the dielectric substrate 21 as in the fourth embodiment. In the ground conductor 22C, a slot group 22*s*C including rectangular slots 22*s*1 and 22*s*2 extending in the Y-axis direction is formed. The strip conductors 23*a*D and 23*b*D are disposed so as to extend in opposite directions to each other with respect to the slot group 22*s*C.

The conductor pattern 23D includes strip conductors 23*a*D and 23*b*D physically separated from each other in the X-axis direction and a coupling conductor 33. Like the coupling conductor 32 (FIG. 9) of the fourth embodiment, the coupling conductor 33 has protruding portions 33*a* and 33*b* protruding from a main body portion of the coupling conductor 33 in the Y-axis direction, and a connecting portion 33*m* connecting the protruding portions 33*a* and 33*b* to each other. The connecting portion 33*m* is disposed between the strip conductors 23*a*D and 23*b*D.

The protruding portions 33*a* and 33*b* have inclined portions 33*c*, 33*e*, 33*d*, and 33*f* which form tapered shapes, and are disposed so as to face, in the Z-axis direction, both end portions of a slot 22*s* in the Y-axis direction. The lateral width (width in the X-axis direction) of a tip of the protruding portion 33*a* is narrower than the entire width of the slot group 22*s*C including the slots 22*s*1 and 22*s*2, and the lateral width (width in the X-axis direction) of a tip of the protruding portion 33*b* is also narrower than the entire width of the slot group 22*s*C including the slots 22*s*1 and 22*s*2. The shapes, dispositions, and functions of these protruding portions 33*a* and 33*b* are the same as those of the protruding portions 32*a* and 32*b* of the fourth embodiment.

Meanwhile, the coupling conductor 33 has a recessed portion 33*g* recessed in the X-axis negative direction and a recessed portion 33*h* recessed in the X-axis positive direction. An inner end portion of the strip conductor 23*a*D which is one of the strip conductors is surrounded by the recessed portion 33*g*, and an inner end portion of the strip conductor 23*b*A which is the other strip conductor is surrounded by the recessed portion 33*h*. As illustrated in FIG. 11, impedance adjusting units 26*a*D and 26*b*D of the present embodiment are formed near the recessed portions 33*g* and 33*h*.

Because the coupling conductor 33 has the protruding portions 33*a* and 33*b* facing the both end portions of the slots 22*s*1 and 22*s*2 as in the first embodiment, the hollow-waveguide-to-planar-waveguide transition circuit 5 of the present embodiment also can achieve low manufacturing cost and high operation reliability while suppressing unnecessary radiation.

Sixth Embodiment

Figure 12:
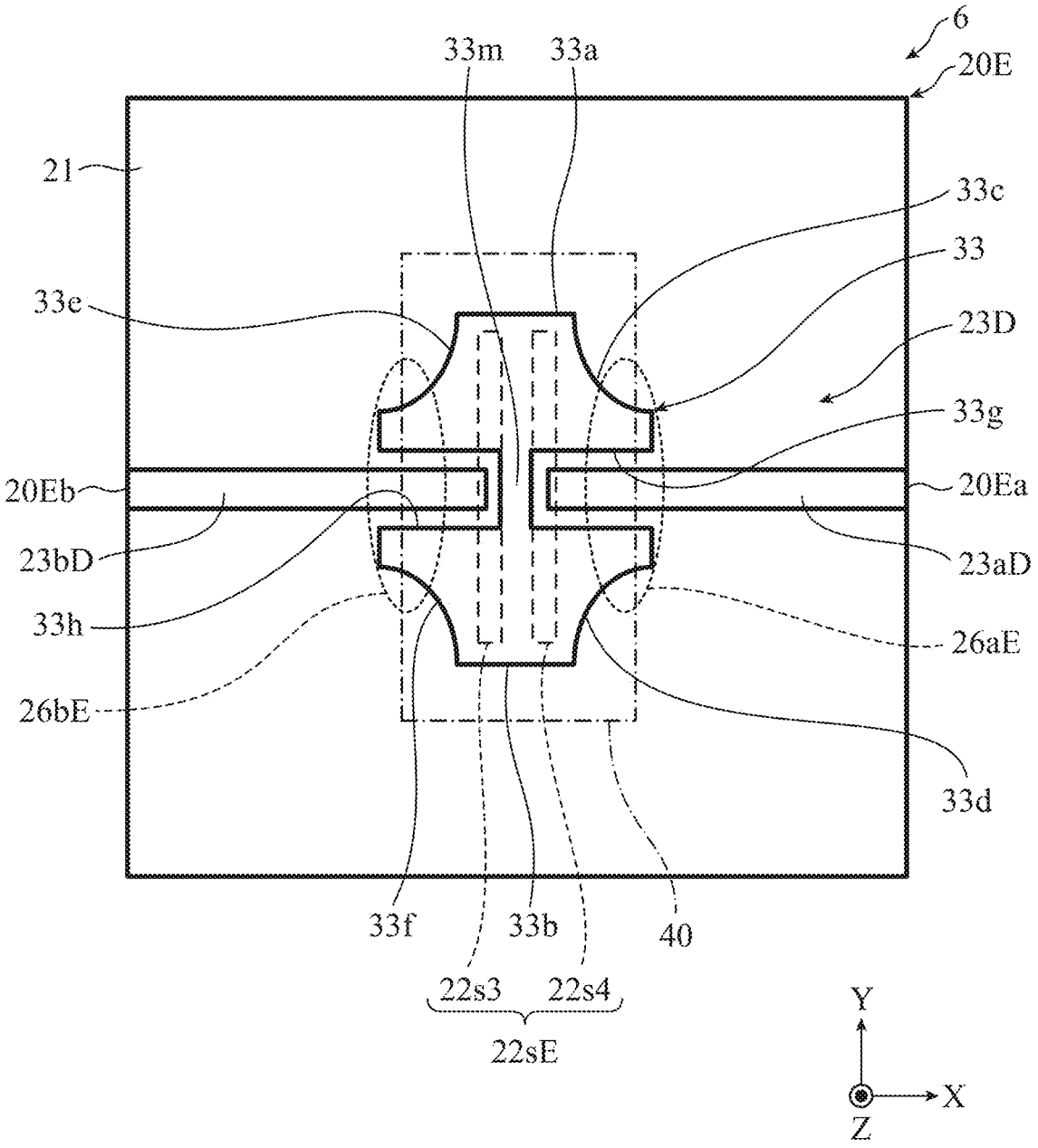
FIG. 12 is a schematic plan view of a hollow-waveguide-to-planar-waveguide transition circuit of a sixth embodiment according to the present invention.

FIG. 12 is a view schematically illustrating the planar structure of a hollow-waveguide-to-planar-waveguide transition circuit 6 of a sixth embodiment which is a modification of the fifth embodiment (as illustrated in FIG. 11). The configuration of the hollow-waveguide-to-planar-waveguide transition circuit 6 is the same as that of the hollow-waveguide-to-planar-waveguide transition circuit 5 of the fifth embodiment except for having a slot group 22*s*E of FIG. 12 instead of the slot group 22*s*C of FIG. 11.

The hollow-waveguide-to-planar-waveguide transition circuit 6 of the present embodiment includes a planar waveguide structure 20E having input/output terminals 20Ea and 20Eb as illustrated in FIG. 12, and the planar waveguide structure 20E has a conductor pattern 23D on the front surface of a dielectric substrate 21 as in the fifth embodiment. In a ground conductor on the back surface of the dielectric substrate 21, the slot group 22*s*E including rectangular slots 22*s*3 and 22*s*4 extending in the Y-axis direction is formed. As illustrated in FIG. 12, a distance between the slots 22*s*3 and 22*s*4 of the present embodiment in the X-axis direction is narrower than a distance between the slots 22*s*1 and 22*s*2 of the fifth embodiment (as illustrated in FIG. 11) in the X-axis direction. Therefore, the protruding portions 33*a* and 33*b* cover the entire slots 22*s*3 and 22*s*4 when viewed from the Z-axis direction. In the present embodiment, as in the fifth embodiment, impedance adjusting units 26*a*E and 26*b*E are formed near recessed portions 33*g* and 33*h* of a coupling conductor 33.

Because the coupling conductor 33 has the protruding portions 33*a* and 33*b* facing the both end portions of the slots 22*s*3 and 22*s*4 (similar to the fifth embodiment (FIG. 11) which has protruding portions 33*a* and 33*b* facing the end portions of the slots 22*s*1 and 22*s*2), the hollow-waveguide-to-planar-waveguide transition circuit 6 of the present embodiment also can achieve low manufacturing cost and high operation reliability while suppressing unnecessary radiation.

Seventh Embodiment

Although the protruding portions 24*a*, 24*b*, 25*a*, 25*b*, 30*a*, 30*b*, 32*a*, 32*b*, 33*a*, and 33*b* of the first to sixth embodiments have tapered shapes, no limitation thereto is intended. The outer shapes of the protruding portions 24*a*, 24*b*, 25*a*, 25*b*, 30*a*, 30*b*, 32*a*, 32*b*, 33*a*, and 33*b* of the first to sixth embodiments may be changed to have stair shapes in which the lateral width of each of the protruding portions changes in a manner that stepwise decreases the lateral width as the location of the lateral width changes from the main body portion of a coupling conductor toward a tip of each of the protruding portions.

Figure 13:
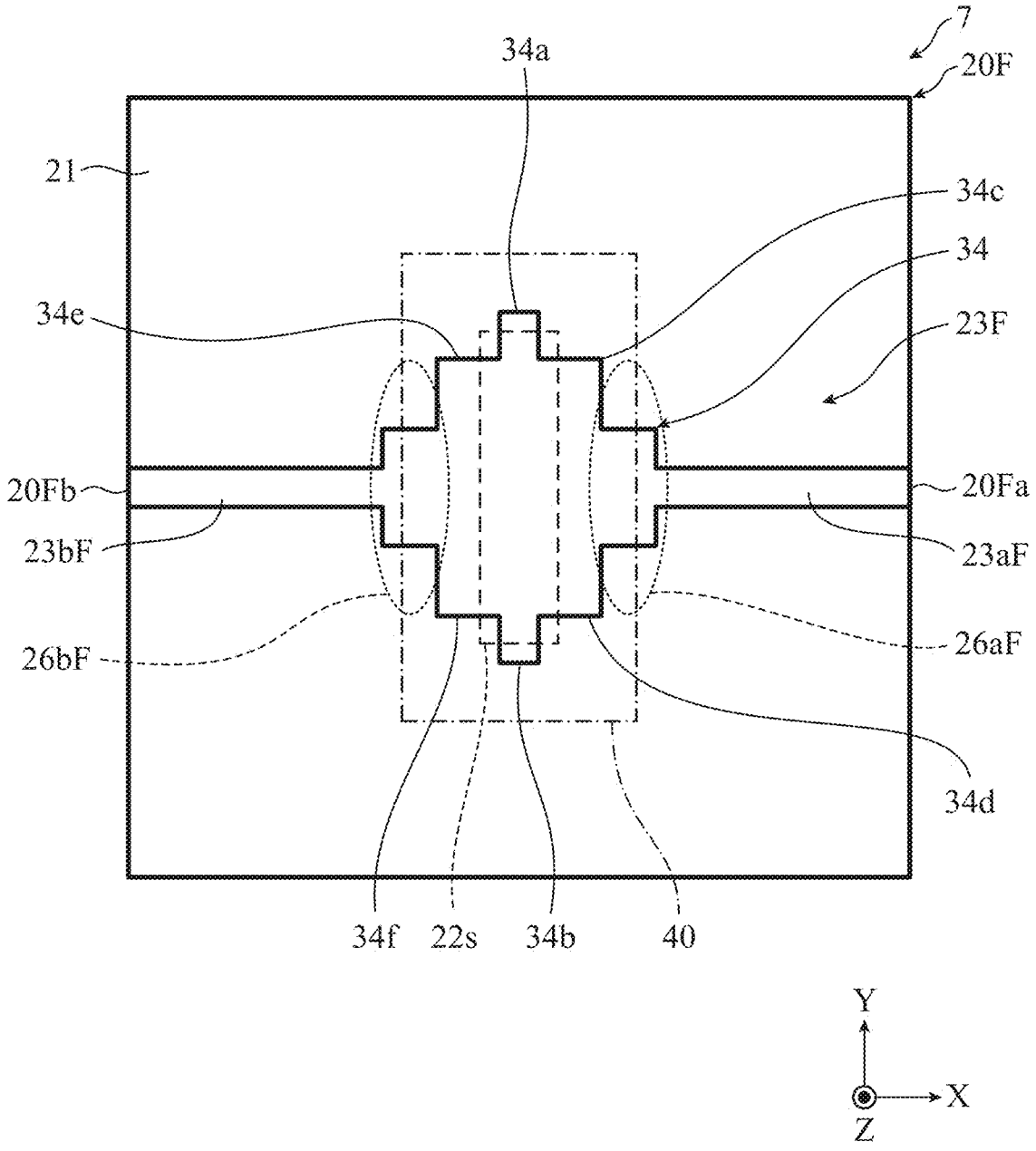
FIG. 13 is a schematic plan view of a hollow-waveguide-to-planar-waveguide transition circuit of a seventh embodiment according to the present invention.

FIG. 13 is a view schematically illustrating the planar structure of a hollow-waveguide-to-planar-waveguide transition circuit 7 of a seventh embodiment which is a modification of the first embodiment. The configuration of the hollow-waveguide-to-planar-waveguide transition circuit 7 is the same as that of the hollow-waveguide-to-planar-waveguide transition circuit 1 of the first embodiment (as illustrated in FIGS. 1 and 2) except for having a conductor pattern 23F of FIG. 13 instead of the conductor pattern 23 of FIG. 1. A step of forming the conductor pattern 23F is the same as the step of forming the conductor pattern 23.

As illustrated in FIG. 13, the hollow-waveguide-to-planar-waveguide transition circuit 7 of the present embodiment includes a planar waveguide structure 20F having input/output terminals 20Fa and 20Fb, and the planar waveguide structure 20F has the conductor pattern 23F on the front surface of a dielectric substrate 21. The conductor pattern 23F includes strip conductors 23*a*F and 23*b*F extending in the X-axis direction and a coupling conductor 34. The coupling conductor 34 has a main body portion electrically coupled with the strip conductors 23*a*F and 23*b*F, a protruding portion 34*a* protruding from the main body portion in the Y-axis positive direction, and a protruding portion 34*b* protruding from the main body portion in the Y-axis negative direction.

The protruding portion 34*a* which is one of the protruding portions has a pair of width-modifying portions 34*c* and 34*e* which form a stair shape. That is, the protruding portion 34*a* has a stair shape in which the lateral width (width in the X-axis direction) of the protruding portion 34*a* changes in a manner that stepwise decreases the lateral width as the location of the lateral width changes from the main body portion toward a tip of the protruding portion 34*a*. The protruding portion 34*b* which is the other protruding portion also has a pair of width-modifying portions 34*d* and 34*f* which form a stair shape. That is, the protruding portion 34*b* has a stair shape in which the lateral width of the protruding portion 34*b* changes in a manner that stepwise decreases the lateral width as the location of the lateral width changes from the main body portion toward a tip of the protruding portion 34*b*.

In the present embodiment, as in the first embodiment, a distance in each of the longitudinal direction and the lateral direction between the tip of the protruding portion 34*a* and an edge of one end portion of a slot 22*s* is set so as to be within one eighth of the wavelength A. Similarly, a distance in each of the longitudinal direction and the lateral direction between the tip of the protruding portion 34*b* and an edge of the other end portion of the slot 22*s* is set so as to be within one eighth of the wavelength A. As illustrated in FIG. 13, impedance adjusting units 26*a*F and 26*b*F of the present embodiment are formed near the both ends of the coupling conductor 34 in the X-axis direction.

Because the coupling conductor 34 has the protruding portions 34*a* and 34*b* facing the both end portions of the slot 22*s* as in the first embodiment, the hollow-waveguide-to-planar-waveguide transition circuit 7 of the present embodiment also can achieve low manufacturing cost and high operation reliability while suppressing unnecessary radiation.

Eighth Embodiment

In the planar waveguide structure 20 of the first embodiment, as illustrated in FIG. 1, the slot 22*s* formed on the back surface of the dielectric substrate 21 has a rectangular shape, although no limitation thereto is intended. The slot may be deformed such that the width (width in the X-axis direction) of each slot at both end portions in a longitudinal direction is larger than the width (width in the X-axis direction) of each slot at the midportion.

Figure 14:
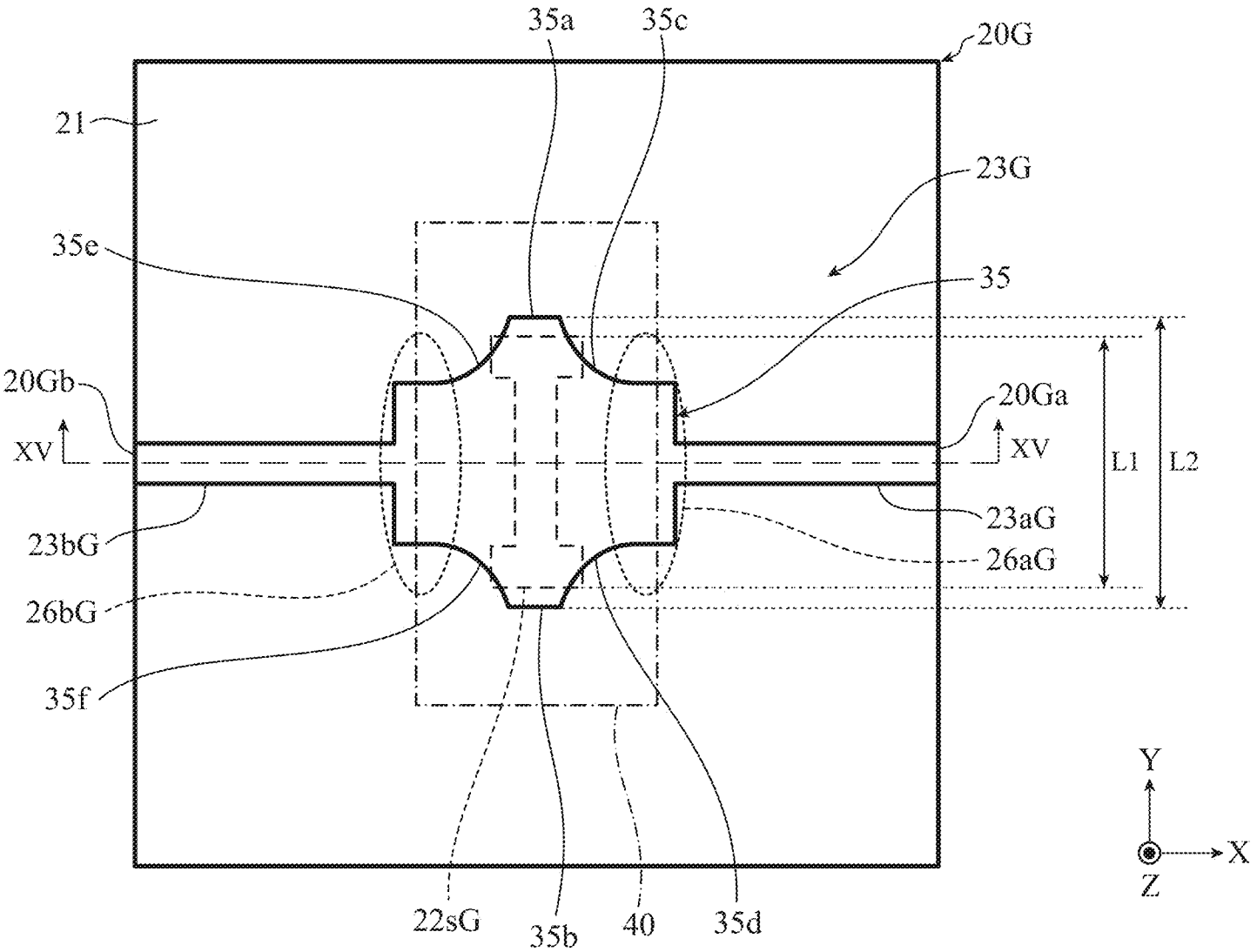
FIG. 14 is a schematic plan view of a hollow-waveguide-to-planar-waveguide transition circuit of an eighth embodiment according to the present invention.
Figure 15:
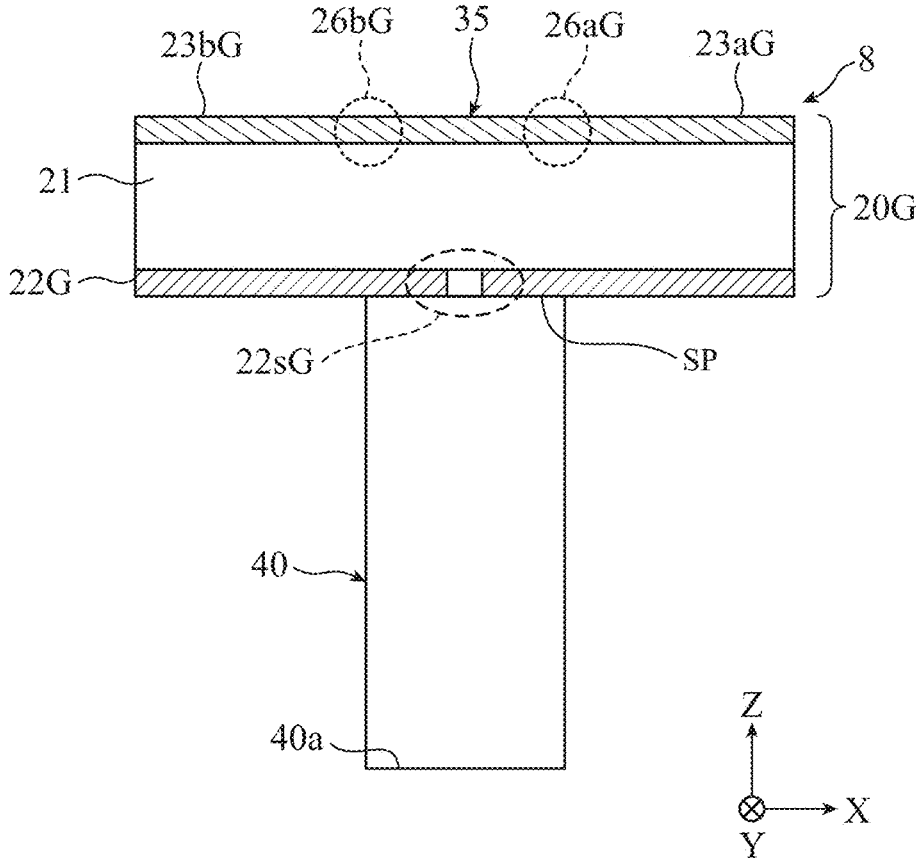
FIG. 15 is a schematic cross-sectional view taken along line XV-XV of the hollow-waveguide-to-planar-waveguide transition circuit illustrated in FIG. 14.

FIG. 14 is a view schematically illustrating the planar structure of a hollow-waveguide-to-planar-waveguide transition circuit 8 of an eighth embodiment according to the present invention. FIG. 15 is a schematic cross-sectional view taken along line XV-XV of the hollow-waveguide-to-planar-waveguide transition circuit 8 illustrated in FIG. 14.

The hollow-waveguide-to-planar-waveguide transition circuit 8 of the present embodiment includes a planar waveguide structure 20G having input/output terminals 20Ga and 20Gb as illustrated in FIG. 14, and the planar waveguide structure 20G has a conductor pattern 23G (FIG. 14) on the front surface of a dielectric substrate 21. As illustrated in FIG. 15, a ground conductor 22G is disposed on the back surface of the dielectric substrate 21. In the ground conductor 22G, a rectangular slot 22*s*G extending in the Y-axis direction is formed. As illustrated in FIG. 14, the width of the slot 22*s*G at both end portions in a longitudinal direction is larger than the width of the slot 22*s*G at the midportion.

The conductor pattern 23G includes strip conductors 23*a*G and 23*b*G extending in the X-axis direction and a coupling conductor 35 electrically coupled with the strip conductors 23*a*G and 23*b*G. The strip conductors 23*a*G and 23*b*G are disposed so as to extend in opposite directions to each other with respect to the slot 22*s*G. A main body portion of the coupling conductor 35 of the present embodiment is physically connected to inner end portions of the strip conductors 23*a*G and 23*b*G.

Like the coupling conductor 24 of the first embodiment (as illustrated in FIGS. 1 and 2), the coupling conductor 35 has protruding portions 35*a* and 35*b* protruding from the main body portion of the coupling conductor 35 in the Y-axis direction as illustrated in FIG. 14, and these protruding portions 35*a* and 35*b* have inclined portions 35*c*, 35*e*, 35*d*, and 35*f* each forming a tapered shape and are disposed so as to face, in the Z-axis direction, both end portions of the slot 22*s*G in the Y-axis direction, as illustrated in FIG. 14. As further illustrated in FIG. 14, impedance adjusting units 26*a*G and 26*b*G of the present embodiment are formed near the both ends of the main body portion of the coupling conductor 35 in the X-axis direction.

The lateral width (width in the X-axis direction) of a tip of the protruding portion 35*a* is narrower than the lateral width of one end portion of the slot 22*s*G in the Y-axis direction, and the lateral width (width in the X-axis direction) of a tip of the protruding portion 35*b* is also narrower than the lateral width of the other end portion of the slot 22*s*G in the Y-axis direction. A distance in each of a longitudinal direction (Y-axis direction) and a lateral direction (X-axis direction) between an edge of one end portion of the slot 22*s*G in the Y-axis direction and the tip of the protruding portion 35*a* is set so as to be equal to or less than one eighth (=λ/8) of the wavelength A corresponding to a center frequency of a frequency band to be used. A distance in each of the longitudinal direction and the lateral direction between an edge of the other end portion of the slot 22*s*G in the Y-axis direction and the tip of the protruding portion 35*b* is similarly set so as to be equal to or less than λ/8.

As illustrated in FIG. 14, the size of the tip portion covering one end portion of the slot 22*s*G in the protruding portion 35*a* in the Y-axis direction is about the same as the size of one end portion of the slot 22*s*G. The size of the tip portion covering the other end portion of the slot 22*s*G in the protruding portion 35*b* in the Y-axis direction is also about the same as the size of the other end portion of the slot 22*s*G. Therefore, the function of the protruding portions 35*a* and 35*b* is substantially the same as the function of the protruding portions 24*a* and 24*b* of the first embodiment (as illustrated in FIGS. 1 and 2). Therefore, it is possible to efficiently transmit a high-frequency signal to the strip conductors 23*a*G and 23*b*G while suppressing unnecessary radiation.

The hollow-waveguide-to-planar-waveguide transition circuit 8 of the present embodiment also can achieve low manufacturing cost and high operation reliability while suppressing unnecessary radiation as in the first embodiment. In the present embodiment, furthermore, because the width of the slot 22*s*G at both end portions is larger than that at the midportion, a length L1 of the slot 22*s*G in a longitudinal direction (Y-axis direction) can be reduced (shortened) while a technical effect similar to that in the first embodiment is maintained. As a result, a length L2 of the conductor pattern 23G in the Y-axis direction can be reduced (shortened). Therefore, it is possible to miniaturize the hollow-waveguide-to-planar-waveguide transition circuit 8.

Note that such a slot 22*s*G can also be applied to the following ninth embodiment.

Ninth Embodiment

In the first to eighth embodiments, the number of the input/output terminals of each of the planar waveguide structures 20 and 20A to 20G is two, although no limitation thereto is intended. The planar waveguide structure of each of the above embodiments may be modified so as to have four or more input/output terminals.

Figure 16:
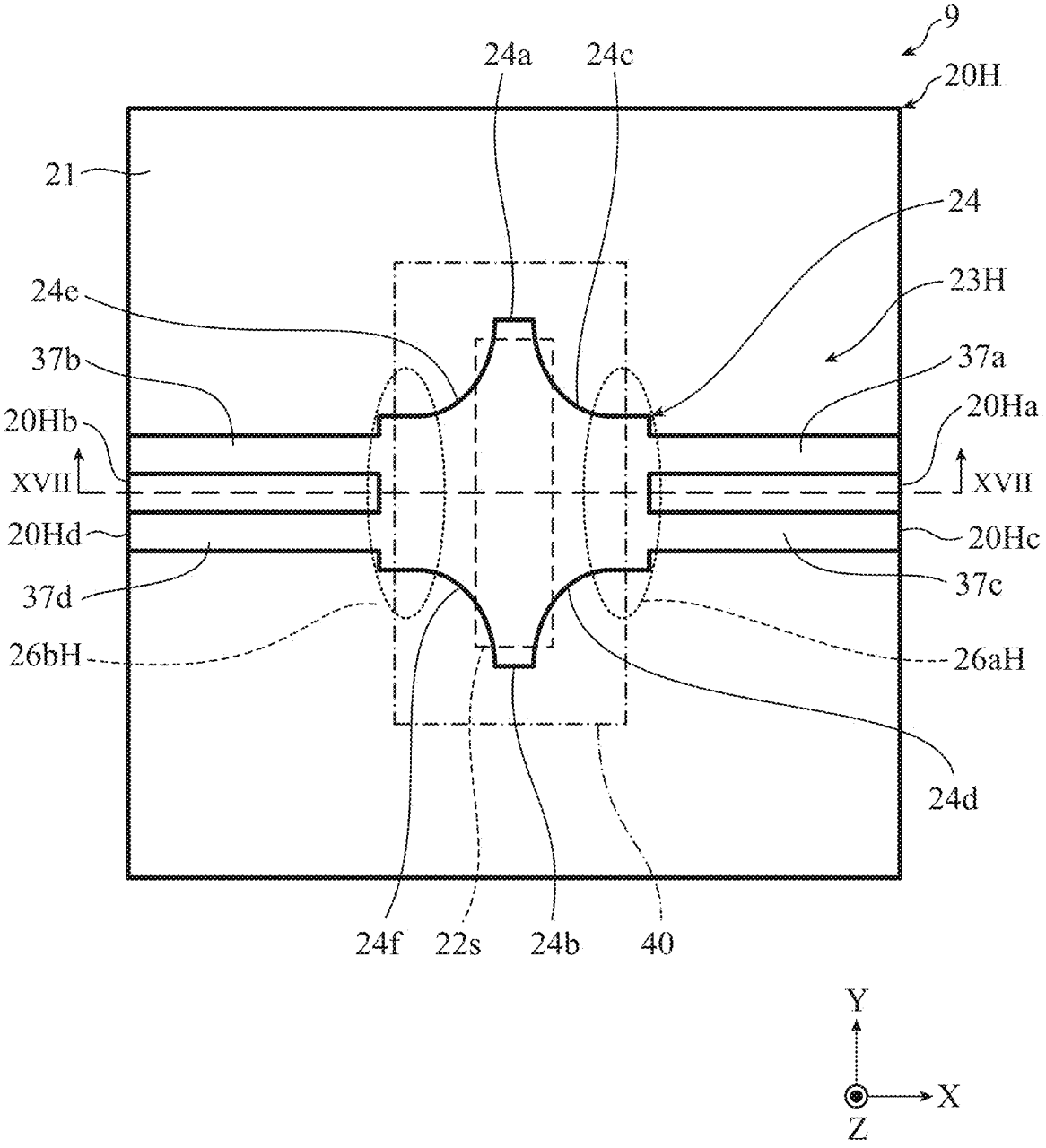
FIG. 16 is a schematic plan view of a hollow-waveguide-to-planar-waveguide transition circuit of a ninth embodiment according to the present invention.
Figure 17:
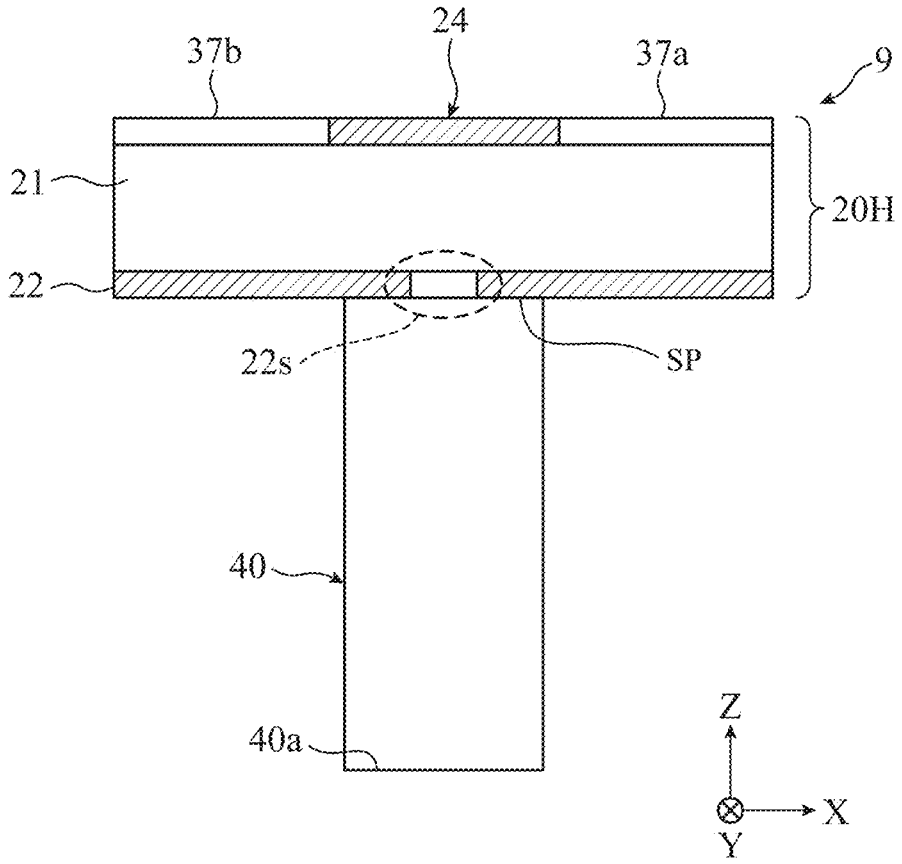
FIG. 17 is a schematic cross-sectional view taken along line XVII-XVII of the hollow-waveguide-to-planar-waveguide transition circuit illustrated in FIG. 16.

FIG. 16 is a view schematically illustrating the planar structure of a hollow-waveguide-to-planar-waveguide transition circuit 9 of a ninth embodiment which is a modification of the first embodiment. FIG. 17 is a schematic cross-sectional view taken along line XVII-XVII of the hollow-waveguide-to-planar-waveguide transition circuit 9 illustrated in FIG. 16. The configuration of the hollow-waveguide-to-planar-waveguide transition circuit 9 is the same as that of the hollow-waveguide-to-planar-waveguide transition circuit 1 of the first embodiment except for having a conductor pattern 23H of FIG. 16 instead of the conductor pattern 23 of FIG. 1. A step of forming the conductor pattern 23H is the same as the step of forming the conductor pattern 23.

The hollow-waveguide-to-planar-waveguide transition circuit 9 of the present embodiment includes a planar waveguide structure 20H having four input/output terminals 20Ha, 20Hb, 20Hc, 20Hd as illustrated in FIG. 16, and the planar waveguide structure 20H has the conductor pattern 23H (FIG. 16) on the front surface of a dielectric substrate 21. This conductor pattern 23H includes a coupling conductor 24 as in the first embodiment (as illustrated in FIGS. 1 and 2). The conductor pattern 23H further includes strip conductors 37*a*, 37*b*, 37*c*, and 37*d* which are linear conductors extending in the X-axis direction as illustrated in FIG. 16. All of the strip conductors 37*a*, 37*b*, 37*c*, and 37*d* are connected to the coupling conductor 24. As illustrated in FIG. 16, impedance adjusting units 26*a*H and 26*b*H are formed near both ends of the coupling conductor 24 in the X-axis direction.

When a high-frequency signal is input to a hollow waveguide 40 (FIG. 17), the input high-frequency signal excites a slot 22*s*. Because the longitudinal direction (Y-axis direction) of the slot 22*s* intersects the longitudinal direction (extending direction) of the strip conductors 37*a*, 37*b*, 37*c*, and 37*d*, the excited slot 22*s* and the strip conductors 37*a*, 37*b*, 37*c*, and 37*d* are magnetically coupled with each other. Then, the high-frequency signal is propagated via a parallel flat line to the input/output terminals 20Ha, 20Hb, 20Hc, and 20Hd of a microstrip line and output. Conversely, when high-frequency signals are input to the input/output terminals 20Ha, 20Hb, 20Hc, and 20Hd of the planar waveguide structure 20H, respectively, these high-frequency signals are combined and then output from an input/output terminal 40*a* of the hollow waveguide 40 (FIG. 17).

As described above in connection with FIG. 16, the planar waveguide structure 20H of the ninth embodiment has four input/output terminals 20Ha, 20Hb, 20Hc, and 20Hd, and therefore can implement the hollow-waveguide-to-planar-waveguide transition circuit 9 also having a function of a multi-divider.

Hereinabove, the various embodiments according to the present invention have been described with reference to the drawings, but these embodiments are examples of the present invention, and various forms other than those embodiments can be also adopted. Within the scope of the present invention, an arbitrary combination of the first to ninth embodiments, modification of any component of each embodiment, or omission of any component in each embodiment is possible.

INDUSTRIAL APPLICABILITY

Because the hollow-waveguide-to-planar-waveguide transition circuit according to the present invention is used in a high-frequency transmission line for transmitting a high-frequency signal such as a millimeter wave or a microwave, it is suitable for use in an antenna device, radar device and communication device which operate in a high-frequency band such as a millimeter wave band or a microwave band.

REFERENCE SIGNS LIST

1 to 9: Hollow-waveguide-to-planar-waveguide transition circuits; 20, 20A to 20H: Planar waveguide structures; 20*a*, 20*b*: Input/output terminals; 21: Dielectric substrate; 22, 22C: Ground conductors; 22*s*: Slot; 23, 23A to 23D, 23G, 23H: Conductor patterns; 23*a*, 23*b*, 23*a*A, 23*b*A, 23*ab*, 23*b*B, 23*ac*, 23*bc*: Strip conductors; 24, 25, 32, 33, 34, 35: Coupling conductors; 24*a*, 24*b*, 25*a*, 25*b*, 30*a*, 30*b*, 31*a*, 31*b*, 32*a*, 32*b*, 33*a*, 33*b*, 34*a*, 34*b*, 35*a*, 35*b*: Protruding portions; 40: Hollow waveguide; 40*a*: Input/output terminal; and SP: Short plane.

The invention claimed is:

1. A hollow-waveguide-to-planar-waveguide transition circuit for transmitting a high-frequency signal, the hollow-waveguide-to-planar-waveguide transition circuit comprising:

a dielectric substrate having a first main surface and a second main surface which face each other in a thickness direction of the dielectric substrate;

one or more strip conductors formed on the first main surface, extending in a first in-plane direction;

a ground conductor formed on the second main surface to face the one or more strip conductors in the thickness direction;

a slot formed in the ground conductor and extending in a second in-plane direction different from the first in-plane direction on the second main surface; and a coupling conductor formed at a position to be electrically coupled with the one or more strip conductors on the first main surface, and disposed at a position facing the slot in the thickness direction, the coupling conductor having a main body portion electrically coupled with the one or more strip conductors, and having a protruding portion protruding from the main body portion in the second in-plane direction, the protruding portion being formed and facing, in the thickness direction, an end portion of the one or more slots in the second in-plane direction, wherein the protruding portion has a stair shape in which a width of the protruding portion in the first in-plane direction changes in a manner that stepwise decreases the width of the protruding portion as a location of the width of the protruding portion changes from the main body portion toward the tip of the protruding portion, and the slot in the ground conductor has a width in the first in-plane direction larger than the width of the protruding portion at a tip of the protruding portion.

2. A hollow-waveguide-to-planar-waveguide transition circuit for transmitting a high-frequency signal, the hollow-waveguide-to-planar-waveguide transition circuit comprising:

a dielectric substrate having a first main surface and a second main surface which face each other in a thickness direction of the dielectric substrate;

one or more strip conductors formed on the first main surface, extending in a first in-plane direction;

a ground conductor formed on the second main surface to face the one or more strip conductors in the thickness direction;

one or more slots formed in the ground conductor and extending in a second in-plane direction different from the first in-plane direction on the second main surface; and a coupling conductor formed at a position to be electrically coupled with the one or more strip conductors on the first main surface, and disposed at a position facing the one or more slots in the thickness direction, the coupling conductor having a main body portion electrically coupled with the one or more strip conductors, and having a protruding portion protruding from the main body portion in the second in-plane direction, the protruding portion being formed and facing, in the thickness direction, an end portion of the one or more slots in the second in-plane direction, wherein:

a tip of the protruding portion is disposed outside the end portion of the one or more slots in the second in-plane direction as viewed from the thickness direction; and a width of the tip of the protruding portion in the first in-plane direction is narrower than an entire width of the one or more slots in the first in-plane direction.

3. A hollow-waveguide-to-planar-waveguide transition circuit for transmitting a high-frequency signal, the hollow-waveguide-to-planar-waveguide transition circuit comprising:

a dielectric substrate having a first main surface and a second main surface which face each other in a thickness direction of the dielectric substrate;

one or more strip conductors formed on the first main surface, extending in a first in-plane direction;

a ground conductor formed on the second main surface to face the one or more strip conductors in the thickness direction;

one or more slots formed in the ground conductor and extending in a second in-plane direction different from the first in-plane direction on the second main surface; and a coupling conductor formed at a position to be electrically coupled with the one or more strip conductors on the first main surface, and disposed at a position facing the one or more slots in the thickness direction, the coupling conductor having a main body portion electrically coupled with the one or more strip conductors, and having a protruding portion protruding from the main body portion in the second in-plane direction, the protruding portion being formed and facing, in the thickness direction, an end portion of the one or more slots in the second in-plane direction, wherein the protruding portion has a tapered shape in which a width of the protruding portion in the first in-plane direction changes in a manner that gradually decreases the width of the protruding portion as a location of the width of the protruding portion changes from the main body portion toward a tip of the protruding portion.

4. A hollow-waveguide-to-planar-waveguide transition circuit for transmitting a high-frequency signal, the hollow-waveguide-to-planar-waveguide transition circuit comprising:

a dielectric substrate having a first main surface and a second main surface which face each other in a thickness direction of the dielectric substrate;

one or more strip conductors formed on the first main surface, extending in a first in-plane direction;

a ground conductor formed on the second main surface to face the one or more strip conductors in the thickness direction;

one or more slots formed in the ground conductor and extending in a second in-plane direction different from the first in-plane direction on the second main surface; and a coupling conductor formed at a position to be electrically coupled with the one or more strip conductors on the first main surface, and disposed at a position facing the one or more slots in the thickness direction, the coupling conductor having a main body portion electrically coupled with the one or more strip conductors, and having a protruding portion protruding from the main body portion in the second in-plane direction, the protruding portion being formed and facing, in the thickness direction, an end portion of the one or more slots in the second in-plane direction, wherein a distance in the second in-plane direction between an edge of the end portion of the one or more slots and a tip of the protruding portion is equal to or less than one eighth of a wavelength corresponding to a center frequency of a predetermined frequency band for use in the high-frequency signal.

5. The hollow-waveguide-to-planar-waveguide transition circuit according to claim 1, wherein each of the one or more slots have respective end portions with corresponding widths that are larger than a width of a midportion of said each of the one or more slots.

6. The hollow-waveguide-to-planar-waveguide transition circuit according to claim 1, further comprising a hollow waveguide having one end portion connected to an area containing the one or more slots in the ground conductor.

7. The hollow-waveguide-to-planar-waveguide transition circuit according to claim 1, further comprising a hollow waveguide having a guide-axis direction and wherein the second main surface and the guide-axis direction are orthogonal to each other.

8. The hollow-waveguide-to-planar-waveguide transition circuit according to claim 1, wherein the main body portion is physically connected to the one or more strip conductors.

9. The hollow-waveguide-to-planar-waveguide transition circuit according to claim 1, wherein the main body portion is disposed to be physically separated from the one or more strip conductors.

10. The hollow-waveguide-to-planar-waveguide transition circuit according to claim 9, wherein:

the one or more strip conductors include a first strip conductor and a second strip conductor which are disposed to be separated from each other; and the coupling conductor includes a first recessed portion that surrounds an end portion of the first strip conductor facing the coupling conductor, and includes a second recessed portion that surrounds an end portion of the second strip conductor facing the coupling conductor.

* * * * *